US007357105B2

(12) United States Patent
Moriwaki et al.

(10) Patent No.: US 7,357,105 B2
(45) Date of Patent: Apr. 15, 2008

(54) HYDRAULIC VALVE DRIVING DEVICE AND ENGINE INCLUDING THE SAME AND VEHICLE

(75) Inventors: Yuji Moriwaki, Shizuoka (JP); Naoki Tsuchida, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 141 days.

(21) Appl. No.: 11/318,741

(22) Filed: Dec. 27, 2005

(65) Prior Publication Data

US 2006/0157010 A1 Jul. 20, 2006

(30) Foreign Application Priority Data

Dec. 28, 2004 (JP) ..... 2004-380455

(51) Int. Cl.
*F01L 9/02* (2006.01)

(52) U.S. Cl. ..... 123/90.12; 123/90.15; 123/90.11; 123/366; 123/179.25; 251/14; 477/99; 192/42; 417/364

(58) Field of Classification Search ..... 123/90.12
See application file for complete search history.

(56) References Cited

U.S. PATENT DOCUMENTS 6,553,966 B2 * 4/2003 Cornell et al. ..... 123/446
6,615,786 B2 * 9/2003 Mori et al. ..... 123/179.31
6,705,266 B2 * 3/2004 Tachikawa et al. ..... 123/179.3
6,736,099 B2 * 5/2004 Mori et al. ..... 123/179.31

FOREIGN PATENT DOCUMENTS

JP 05-202710 8/1993

* cited by examiner

*Primary Examiner*—Thomas Denion
*Assistant Examiner*—Kyle M. Riddle
(74) *Attorney, Agent, or Firm*—Keating & Bennett, LLP

(57) ABSTRACT

A hydraulic valve driving device includes a valve actuator operable to drive an engine valve, a hydraulic pump that generates the oil pressure for the valve actuator, a hydraulic pump driving motor that drives the hydraulic pump, and a starter motor. At the time of engine starting, after the hydraulic pump is driven by the hydraulic pump driving motor while the crank is stopped in the first engine-starting mode, and then the crank and the hydraulic pump are driven by the starter motor in the second engine-starting mode.

20 Claims, 14 Drawing Sheets

HYDRAULIC VALVE DRIVING DEVICE AND ENGINE INCLUDING THE SAME AND VEHICLE

BACKGROUND OF THE INVENTION

1. Field of the Invention

The present invention relates to a hydraulic valve driving device that drives an engine valve using hydraulic pressure and an engine including the hydraulic valve driving device and a vehicle including the engine.

2. Description of the Background Art

There have been conventionally known hydraulic valve driving devices that drive an engine valve including an intake valve and an exhaust valve using oil pressure (see, for example, JP 5-202710 A).

Such a hydraulic valve driving device is provided with a hydraulic pump operable to generate oil pressure. In the hydraulic valve driving device disclosed by JP 5-202710 A, at the time of engine starting, the intake valve and the exhaust valve are prevented from operating before the oil pressure in the hydraulic pump reaches a prescribed value or higher, so that the intake valve and the exhaust valve are allowed to operate in a stable manner.

In the hydraulic valve driving device disclosed by JP 5-202710 A, the hydraulic pump is generally driven by a crank in the engine.

In the hydraulic valve driving device that drives the hydraulic pump by the crank, however, the hydraulic pump is driven together with the engine itself whose inertia is large, and therefore the rotation speed of the hydraulic pump is not quickly raised. Therefore, it takes long for the oil pressure to be raised, and therefore it takes long before the engine valve is driven stably. This makes it difficult to conduct quick and good engine starting.

At the time of engine starting, the crank must be driven with high torque in order to overcome the initial compression stroke. The viscosity of operation oil for the hydraulic pump is high. As described above, it is necessary to drive the crank requiring high torque and the hydraulic pump with the operation oil having high viscosity at the same time for the purpose of increasing the oil pressure, which requires a large amount of energy. Consequently, necessary oil pressure cannot be obtained instantaneously and good engine starting cannot be carried out.

SUMMARY OF THE INVENTION

In order to overcome the problems described above, preferred embodiments of the present invention provide a hydraulic valve driving device that allows quick and improved engine starting to be conducted with reduced energy, an engine including such a hydraulic valve driving device, and a vehicle including such an engine.

(1)

According to a preferred embodiment of the present invention, a hydraulic valve driving device that drives a valve in an engine having a crank includes a hydraulic valve actuator operable to drive the valve, a hydraulic pump that generates hydraulic pressure for the valve actuator, first and second motors that generate rotational force, and a transmission mechanism that operates in a first engine-starting mode and then in a second engine-starting mode at the time of engine starting, and the transmission mechanism transmits rotational force from the first motor to the hydraulic pump while the crank is at rest in the first engine-starting mode, and the transmission mechanism transmits rotational force from the second motor to the crank and the hydraulic pump in the second engine-starting mode.

In the hydraulic valve driving device, hydraulic pressure for the valve actuator is generated by the hydraulic pump, and the valve in the engine is driven by the hydraulic valve driving device. The transmission mechanism transmits rotational force from the first motor to the hydraulic pump while the crank is at rest in the first engine-starting mode. Then, in the second engine-starting mode, the transmission mechanism transmits rotational force from the second motor to the crank and the hydraulic pump.

In this way, the hydraulic pump is driven by the first motor not through the crank in the first engine-starting mode at the time of engine starting. In this case, the first motor can drive the hydraulic pump with a small load. Therefore, the rotational speed of the hydraulic pump is raised faster than the case of driving the hydraulic pump using the crank. Therefore, the necessary time before the hydraulic pressure of the hydraulic pump rises to a value necessary for driving the valve actuator can be shortened, and power consumption by the first motor can be reduced. Therefore, more quick and improved engine starting can be carried out with reduced energy.

(2)

The first and second motors may be provided discretely, and the first motor may be at rest in the second engine-starting mode.

In this way, after the hydraulic pump is driven by the first motor in the first engine-starting mode, the crank and the hydraulic pump are driven by the second motor in the second engine-starting mode. At the time, since the first motor is at rest, electric power is not wasted.

(3)

The second motor may drive the crank, and the transmission mechanism may transmit the rotational force of the crank to the hydraulic pump in the second engine-starting mode.

In this way, after the rotational speed of the hydraulic pump is raised in the first engine-starting mode, the hydraulic pump is driven by cranking by the second motor in the second engine-starting mode.

(4)

The transmission mechanism may include a clutch that switches transmission of rotational force from the first motor to the hydraulic pump in the first engine-starting mode to transmission of rotational force from the crank to the hydraulic pump in the second engine-starting mode.

In this way, by the function of the clutch, driving of the hydraulic pump by the first motor in the first engine-starting mode can readily be switched to driving of the hydraulic pump in the second engine-starting mode.

(5)

The clutch may include a first one-way clutch provided in a rotational transmission path between the first motor and the hydraulic pump to transmit rotational force from the first motor to the hydraulic pump but not from the hydraulic pump to the first motor, and a second one-way clutch provided in a rotational transmission path between the crank and the hydraulic pump to transmit rotational force from the crank to the hydraulic pump but not from the hydraulic pump to the crank.

In this way, in the first engine-starting mode, rotational force from the first motor can be prevented from being transmitted to the crank through the hydraulic pump by the function of the second one-way clutch. Therefore, in the first engine-starting mode, the hydraulic pump is driven by the first motor while the crank is not.

In addition, in the second engine-starting mode, rotational force from the crank can be prevented from being transmitted to the first motor through the hydraulic pump by the function of the first one-way clutch. Therefore, in the second engine-starting mode, the hydraulic pump is driven by the crank while the first motor is not.

(6)

The first and second motors may be a common motor.

In this way, the hydraulic pump is driven by the common motor in the first engine-starting mode, and the hydraulic pump is driven and cranking is carried out by the common motor in the second engine-starting mode. Therefore, it is not necessary to provide a dedicated motor for driving the hydraulic pump in addition to the motor for cranking. This keeps the number of parts from increasing while the hydraulic pump can be driven by the common motor in the first engine-starting mode.

(7)

The common motor may include a starter motor that starts the engine, and the transmission mechanism may transmit rotational force from the starter motor to the hydraulic pump in the first engine-starting mode, and transmit rotational force from the starter motor to the crank and the hydraulic pump in the second engine-starting mode.

In this way, the hydraulic pump is driven by the starter motor in the first engine-starting mode, and the hydraulic pump is driven and cranking is carried out by the starter motor in the second engine-starting mode. Therefore, it is not necessary to provide a dedicated motor for driving the hydraulic pump in addition to the starter motor. This keeps the number of parts from increasing while the hydraulic pump can be driven by the starter motor in the first engine-starting mode.

(8)

The transmission mechanism may include a third one-way clutch provided in a first rotational transmission path between the starter motor and the hydraulic pump to transmit rotational force from the starter motor to the hydraulic pump but not from the hydraulic pump to the starter motor, a first switching clutch provided in a second rotational transmission path between the hydraulic pump and the crank to switch between connected and disconnected states of the hydraulic pump and the crank, a fourth one-way clutch provided between the first switching clutch in the second rotational transmission path and the crank to transmit rotational force from the hydraulic pump to the crank but not from the crank to the hydraulic pump, and a second switching clutch provided in a third rotational transmission path between the crank and the hydraulic pump to switch between connected and disconnected states of the crank and the hydraulic pump.

In this way, in the first engine-starting mode, rotational force is transmitted from the starter motor to the hydraulic pump but not from the hydraulic pump to the starter motor by the function of the third one-way clutch. The first and second switching clutches provided in the second and third rotational transmission paths respectively between the hydraulic pump and the crank are disconnected. In this way, rotational force from the starter motor can be prevented from being transmitted to the crank through the hydraulic pump. Therefore, in the first engine-starting mode, the hydraulic pump is driven by the starter motor while the crank is not.

In the second engine-starting mode, the first switching clutch provided in the second transmission path between the hydraulic pump and the crank is connected. In this way, rotational force is transmitted from the starter motor to the crank through the hydraulic pump but not from the crank to the starter motor through the hydraulic pump by the function of the third and fourth one-way clutches.

During the normal running mode, the first switching clutch provided in the second rotational transmission path between the hydraulic pump and the crank is disconnected, while the second switching clutches provided in the third rotational transmission path between the hydraulic pump and the crank is connected. Therefore, rotational force is transmitted from the crank to the hydraulic pump. At the time, the rotational force from the crank can be prevented from being transmitted to the starter motor through the hydraulic pump by the function of the third one-way switch.

Furthermore, since the second and third rotational transmission paths are provided between the hydraulic pump and the crank, the speed ratio between the rotation number of the crank and the rotation number of the hydraulic pump can be set independently between when the crank is driven by the rotational force of the starter motor through the hydraulic pump during cranking and when the hydraulic pump is driven by the driving force of the engine through the crank during the normal running mode.

(9)

The transmission mechanism may switch from the first engine-starting mode to the second engine-starting mode when the hydraulic pressure of the hydraulic pump reaches at least a prescribed value during operation in the first engine-starting mode.

In this way, the crank can be driven in the second engine-starting mode while the hydraulic pressure of the hydraulic pump is at least at a prescribed value. Therefore, the operation of the engine valve can be prevented from being unstable during cranking.

After the hydraulic pressure is raised to such a value that the engine valve can stably be driven in the first engine-starting mode, cranking can be started in the second engine-starting mode. Therefore, the engine can be started shortly after the start of cranking.

(10)

The transmission mechanism may switch from the first engine-starting mode to the second engine-starting mode when the operation duration of the hydraulic pump reaches at least a prescribed period during operation in the first engine-starting mode.

In this way, the hydraulic pressure of the hydraulic pump rises to a prescribed value or higher after the operation duration of the hydraulic pump reaches at least the prescribed period. Therefore, the crank can be driven in the second engine-starting mode while the hydraulic pressure of the oil pump is at least the prescribed value. Therefore, the engine valve can be prevented from being unstable during cranking.

After the hydraulic pressure is raised to such a value that the engine valve can stably be driven in the first engine-starting mode, cranking can be started in the second engine-starting mode. Therefore, the engine can be started shortly after the start of cranking.

In addition, it is not necessary to provide an additional hydraulic pressure sensor for measuring the hydraulic pressure of the hydraulic pump. This keeps the number of parts from increasing and switching from the first staring mode to the second engine-starting mode can smoothly be carried out.

(11)

The prescribed period may be set based on the temperature of the engine.

If the temperature of the engine is low, the viscosity of operating fluid for the hydraulic pump is high and there is high fluid resistance, so that it takes long before hydraulic pressure necessary for driving the engine valve is provided. Therefore, if the temperature of the engine is high, the prescribed period is set short and if the temperature of the engine is low, the prescribed period is set long.

In this way, control closer to the transition from the first engine-starting mode to the second engine-starting mode by detecting the hydraulic pressure of the hydraulic pump can be carried out. Therefore, the operation of the engine valve can readily be prevented from being unstable by setting the prescribed period based on the temperature of the engine.

(12)

The transmission mechanism may switch from the first engine-starting mode to the second engine-starting mode when the cumulative rotation number of the hydraulic pump reaches at least a prescribed rotation number during operation in the first engine-starting mode.

In this way, the hydraulic pressure of the hydraulic pump increases to at least the prescribed value as the cumulative rotation number of the hydraulic pump increases to at least the prescribed number. Therefore, the crank can be driven in the second engine-starting mode while the hydraulic pressure of the hydraulic pump is raised at least to the prescribed value. In this way, the operation of the engine valve can be prevented from being unstable during cranking.

Furthermore, after the hydraulic pressure is raised to such a value that the engine valve can stably be driven in the first engine-starting mode, cranking can be started in the second engine-starting mode. Therefore, the engine can be started shortly after the start of cranking.

It is not necessary to provide an additional hydraulic pressure sensor for measuring the hydraulic pressure of the hydraulic pump. This keeps the number of parts from increasing and switching from the first staring mode to the second engine-starting mode can smoothly be carried out.

(13)

The prescribed rotation number may be set based on the temperature of the engine.

If the temperature of the engine is low, the viscosity of operating fluid is high and there is high fluid resistance, which increases the cumulative rotation number of the hydraulic pump necessary for driving the engine valve. Therefore, if the temperature of the engine is high, the prescribed rotation number is set short and if the temperature of the engine is low, the prescribed rotation number is set large.

In this way, control closer to the transition from the first engine-starting mode to the second engine-starting mode by detecting the hydraulic pressure of the hydraulic pump can be carried out. Therefore, the operation of the engine valve can readily be prevented from being unstable by setting the prescribed rotation number based on the temperature of the engine.

(14)

The hydraulic valve driving device may further include a main switch that controls supply of electric power to the engine, and a controller that sets the transmission mechanism to the first staring mode when the main switch is turned on.

In this way, before initiating staring of the engine, the driver can turn on the main switch to drive the hydraulic pump and raise the hydraulic pressure of the hydraulic pump in advance. Therefore, the period after the driver instructs starting of the engine and before the second engine-starting mode is attained can be shortened. Therefore, more quick and improved engine starting can be carried out.

(15)

The hydraulic valve driving device may further include an instructing device that instructs driving of the crank, and the controller may stop operation of the hydraulic pump after the start of the first engine-starting mode in response to turning on of the main switch at least one of when the hydraulic pressure of the hydraulic pump reaches at least a prescribed value and when the cumulative rotation number of the hydraulic pump reaches at least a prescribed rotation number, provided that there is no instruction from the instructing device to drive the crank.

In this way, electric power can be prevented from being wasted by the second motor when the driver does not instruct driving of the crank within a prescribed time period after turning on the main switch, in other words, when starting of the engine is not carried out. Therefore, electric power charged in the battery can be prevented from being discharged.

(16)

The hydraulic valve driving device may further include an instructing device that instructs driving of the crank, and the controller may switch the mode of the transmission mechanism from the first engine-starting mode to the second engine-starting mode after the start of the first engine-starting mode, at least one of when the hydraulic pressure of the hydraulic pump is less than a prescribed value, when the driving duration of the hydraulic pump is less than a prescribed period, and when the cumulative rotation number of the hydraulic pump is less than a prescribed rotation number, provided that there is an instruction from the instructing device to drive the crank.

In this way, when the main switch is pressed, the hydraulic pressure of the hydraulic pump is raised to some extent in the first engine-starting mode. The hydraulic pressure of the hydraulic pump can readily be raised in the second engine-starting mode when the hydraulic pressure of the hydraulic pump is less than a prescribed value, when the driving duration of the hydraulic pump is less than the a prescribed period, or when the cumulative rotation number of the hydraulic pump is less than a prescribed rotation number. Therefore, the engine valve can be prevented from being driven while the hydraulic pressure is lowered.

(17)

The valve may include a plurality of valves, in the second engine-starting mode, the second motor drives the crank to carry out cranking while the engine is yet to be started, and a valve actuator may open at least one of the plurality of valves during the cranking.

In this case, the cylinder can be prevented from being sealed during cranking in the second engine-starting mode. The pressure of compressed air in the cylinder can be prevented from increasing while the piston reciprocates. Therefore, the torque for driving the crank can be reduced, and the rotational speed of the engine can be increased in a shorter time. As a result, more quick and improved engine starting can be carried out.

(18)

The valve actuator may open at least one of the plurality of valves with such a lift amount that the valve does not collide against a piston in the engine during cranking in the second engine-starting mode.

In this way, during cranking in the second engine-starting mode, torque for driving the crank can be reduced while the engine valve and piston are prevented from being damaged.

(19)

After at least one of the plurality of valves is opened and before the cranking ends, the valve actuator may keep the lift amount of the opened valve at a constant level.

In this way, it is not necessary to change the lift amount of the valve while the engine valve is opened during cranking, so that energy consumption can be reduced.

(20)

The controller may start the engine when the rotational speed of the engine reaches at least a prescribed speed in the second engine-starting mode and have the crank driven by the engine.

In this way, the engine can be started while the rotational speed of the engine is raised. Therefore, transition from the second engine-starting mode to the normal running mode can smoothly be conducted.

(21)

An engine according to another preferred embodiment of the invention includes a cylinder having a valve, a piston stored in the cylinder and capable of reciprocating therein, a crank that transforms the reciprocating motion of the piston into rotational motion, and a hydraulic valve driving device that drives the valve, the hydraulic valve driving device includes a hydraulic valve actuator operable to drive the valve, a hydraulic pump that generates hydraulic pressure for the valve actuator, first and second motors that generate rotational force, and a transmission mechanism that operates in a first engine-starting mode and then in a second engine-starting mode at the time of engine starting, and the transmission mechanism transmits rotational force from the first motor to the hydraulic pump while the crank is at rest in the first engine-starting mode, and the transmission mechanism transmits rotational force from the second motor to the crank and the hydraulic pump in the second engine-starting mode.

In the engine, as reciprocating motion is transformed into rotational motion, the valve is driven by the hydraulic valve driving device.

In the hydraulic valve driving device, hydraulic pressure for the valve actuator is generated by the hydraulic pump, and the engine valve is driven by the hydraulic valve driving device. In the first engine-starting mode at the time of engine starting, rotational force from the first motor is transmitted to the hydraulic pump by the transmission mechanism while the crank is at rest. Then, in the second engine-starting mode, rotational force from the second motor is transmitted to the crank and the hydraulic pump by the transmission mechanism.

In this way, in the first engine-starting mode at the time of engine starting, the hydraulic pump is driven by the first motor not through the crank. In this case, the first motor can be driven the hydraulic pump with a small load. Therefore, the rotational speed of the hydraulic pump can be raised faster than the case of driving the hydraulic pump by the crank. In this way, the time necessary for the hydraulic pressure of the hydraulic pump to increase to a value necessary for driving the valve actuator can be shortened, and the power consumption by the first motor can be reduced. Consequently, more quick and improved engine starting can be carried out with reduced energy.

(22)

A vehicle according to yet another preferred embodiment of the invention includes an engine that generates power, and a driving wheel driven by the power generated by the engine, the engine includes a cylinder having a valve, a piston stored in the cylinder and capable of reciprocating therein, a crank that transforms the reciprocating motion of the piston into rotational motion, and a hydraulic valve driving device that drives the valve, the hydraulic valve driving device includes a hydraulic valve actuator operable to drive the valve, a hydraulic pump that generates hydraulic pressure for the valve actuator, first and second motors that generate rotational force, and a transmission mechanism that operates in a first engine-starting mode and then in a second engine-starting mode at the time of engine starting, and the transmission mechanism transmits rotational force from the first motor to the hydraulic pump while the crank is at rest in the first engine-starting mode, and the transmission mechanism transmits rotational force from the second motor to the crank and the hydraulic pump in the second engine-starting mode.

In the vehicle, the driving wheel is driven by power generated by the engine. In the engine, as the reciprocating motion of the piston is transformed into rotational motion by the crank, the valve is driven by the hydraulic valve driving device.

In the hydraulic valve driving device, hydraulic pressure for the valve actuator is generated by the hydraulic pump, and the engine valve is driven by the hydraulic valve driving device. In the first engine-starting mode at the time of starting, rotational force from the first motor is transmitted to the hydraulic pump by the transmission mechanism while the crank is at rest. Then, in the second engine-starting mode, rotational force from the second motor is transmitted to the crank and the hydraulic pump by the transmission mechanism.

In this way, in the first engine-starting mode at the time of engine starting, the hydraulic pump is driven by the first motor not through the crank. In this case, the first motor can drive the hydraulic pump with a small load. Therefore, the rotational speed of the hydraulic pump can be raised faster than the case of driving the hydraulic pump by the crank. Therefore, the time necessary for the hydraulic pressure of the hydraulic pump to be raised to a value necessary for driving the valve actuator can be shortened, and the power consumption by the first motor can be reduced. Consequently, more quick and improved engine starting can be carried out with reduced energy.

Other features, elements, characteristics, and advantages of the present invention will become more apparent from the following description of preferred embodiments of the present invention with reference to the attached drawings.

DETAILED DESCRIPTION OF THE PREFERRED EMBODIMENTS

Now, preferred embodiments of the invention will be described with reference to the accompanying drawings. In the following preferred embodiments, a motorcycle will be described as an example of a vehicle according to the invention.

(1) First Preferred Embodiment

Now, with reference to FIGS. 1 to 4, an engine including a hydraulic valve driving device according to a first preferred embodiment of the invention will be described.

(1-1) Structure of Engine

Figure 1:
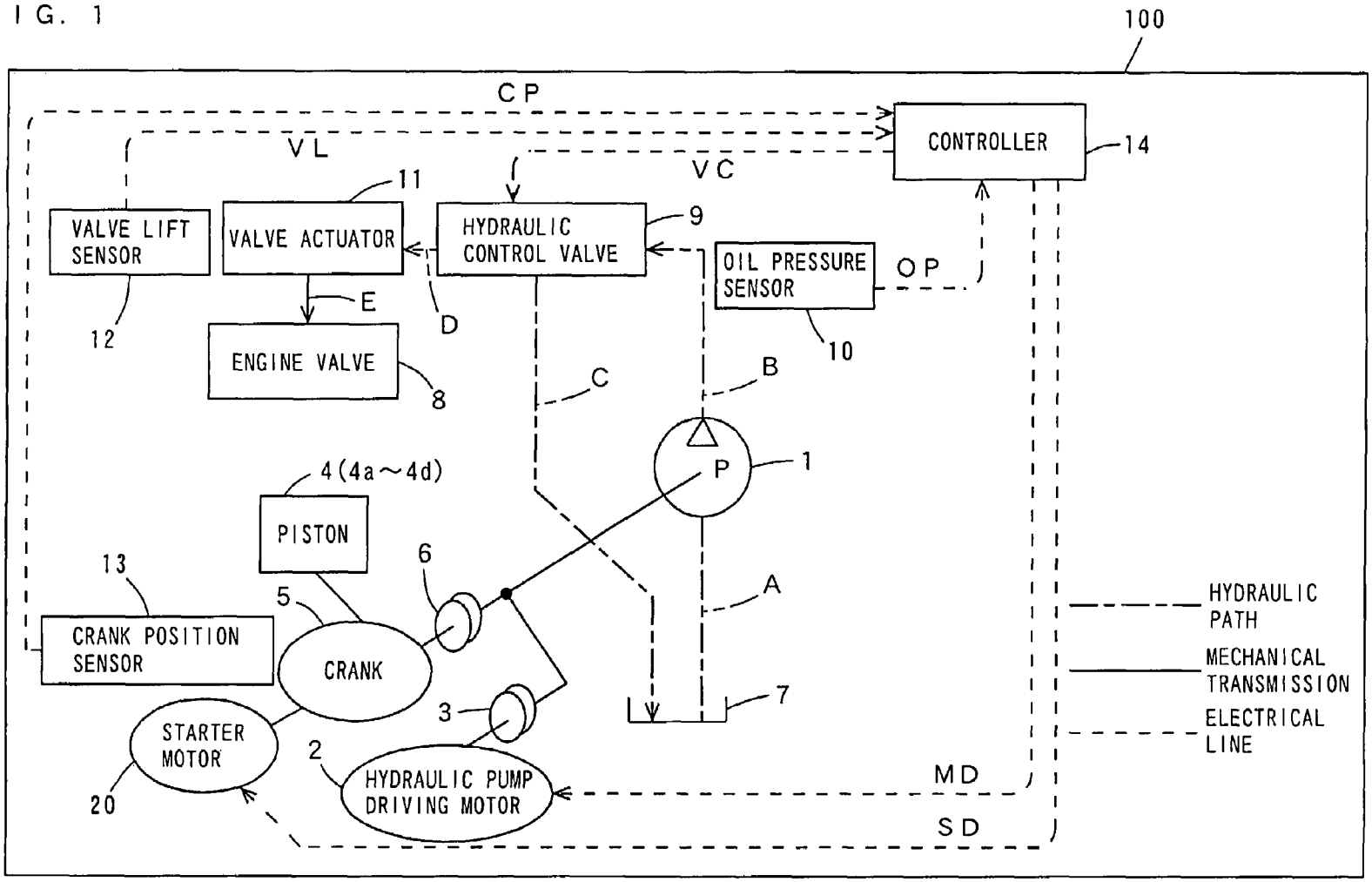
FIG. 1 is a schematic diagram of a general structure of a hydraulic valve driving device in an engine according to a first preferred embodiment of the invention.

FIG. 1 is a schematic view of a general structure of a hydraulic valve driving device in an engine according to the first preferred embodiment of the invention.

As shown in FIG. 1, the hydraulic valve driving device in the engine 100 according to the first preferred embodiment includes a hydraulic pump 1, a hydraulic pump driving motor 2, transmission switching mechanisms 3 and 6, an oil tank 7, an engine valve 8, a hydraulic control valve 9, an oil pressure sensor 10, a valve actuator 11, a valve lift sensor 12, a crank position sensor 13, and a controller 14.

The hydraulic pump driving motor 2 is provided to drive the hydraulic pump 1. The transmission switching mechanism 3 transmits driving force by the driving motor 2 to the hydraulic pump 1. The transmission switching mechanism 6 transmits driving force by a crank 5 coupled to a piston 4 to the hydraulic pump 1. The oil tank 7 stores oil. The engine valve 8 includes an intake valve and an exhaust valve. The hydraulic control valve 9 switches between hydraulic paths to control oil pressure.

The oil pressure sensor 10 detects oil pressure and outputs an oil pressure signal OP indicating the oil pressure. The valve actuator 11 drives the engine valve 8 by oil pressure. The valve lift sensor 12 detects the lift amount of the engine valve 8 and outputs a valve lift signal VL indicating the lift amount. The crank position sensor 13 detects the crank angle of the crank 5 and outputs a crank position signal CP indicating the crank angle.

Herein, the valve lift sensor 12 indirectly detects the lift amount of the engine valve 8 including the intake and exhaust valves by measuring the operation amount of the valve actuator 11.

The crank 5 is connected with a starter motor 20 for carrying out cranking at the time of starting the engine. The starter motor 20 is driven in response to pressing of the starter switch 160 in FIG. 14 that will be described.

The hydraulic pump 1 is supplied with oil through a hydraulic path A from the oil tank 7. The oil pressure pump 1 and the hydraulic control valve 9 are connected by a hydraulic path B. Oil stored in the oil tank 7 is pressurized by the hydraulic pump 1 and then sent to the hydraulic control valve 9.

The oil pressure sensor 10 is provided in the hydraulic path B. The hydraulic control valve 9 is connected to the valve actuator 11 through a hydraulic path D. The hydraulic control valve 9 opens and closes the hydraulic path D as an electromagnetic valve (not shown) is turned on and off in response to a valve control signal VC output from the controller 14.

The hydraulic control valve 9 is connected to the oil tank 7 through a return path (hydraulic path) C. When the engine valve 8 is closed, oil is returned to the oil tank 7 from the hydraulic control valve 9 through the return path C.

The valve actuator 11 is connected to the engine valve 8 through a mechanical transmission mechanism E and controls the engine valve 8 by oil pressure controlled by the hydraulic control valve 9.

The controller 14 is provided with the oil pressure signal OP output from the oil pressure sensor 10, the valve lift signal VL output from the valve lift sensor 12, the crank position signal CP output from the crank position sensor 13, and other signals. The controller 14 applies a motor driving signal MD and a starter motor driving signal SD to the hydraulic pump driving motor 2 and the starter motor 20, respectively.

The engine 100 according to the preferred embodiment is a four-cylinder engine having four cylinders. The four cylinders are provided with pistons 4*a* to 4*d*, respectively. The four pistons 4*a* to 4*d* are collectively referred to as piston 4. The four cylinders are each provided with an engine valve 8 (intake and exhaust valves).

(1-2) Structure of Hydraulic Valve Driving Device

Figure 2:
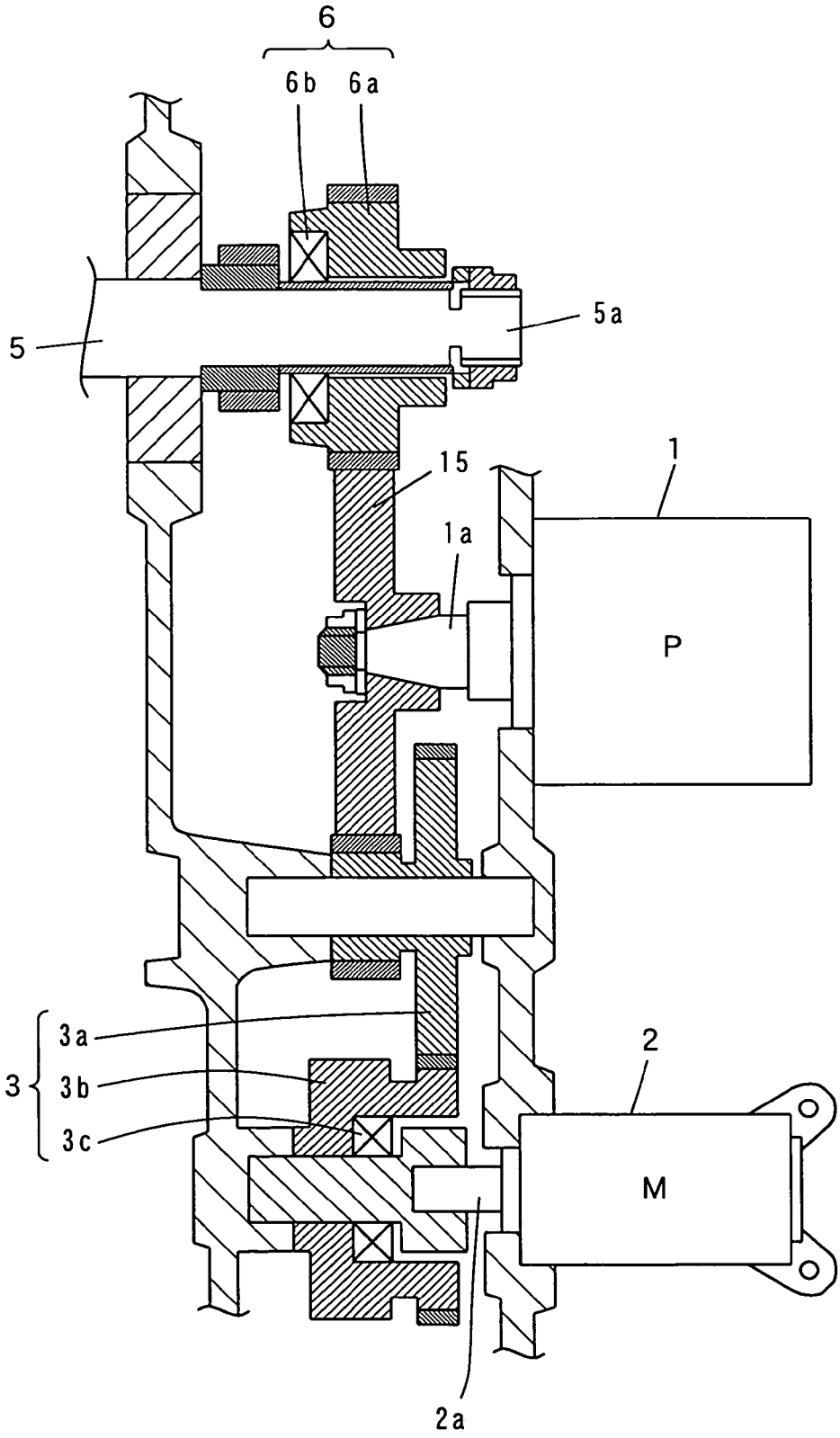
FIG. 2 is a sectional view illustrating in detail the hydraulic valve driving device in the engine in FIG. 1.
Figure 3:
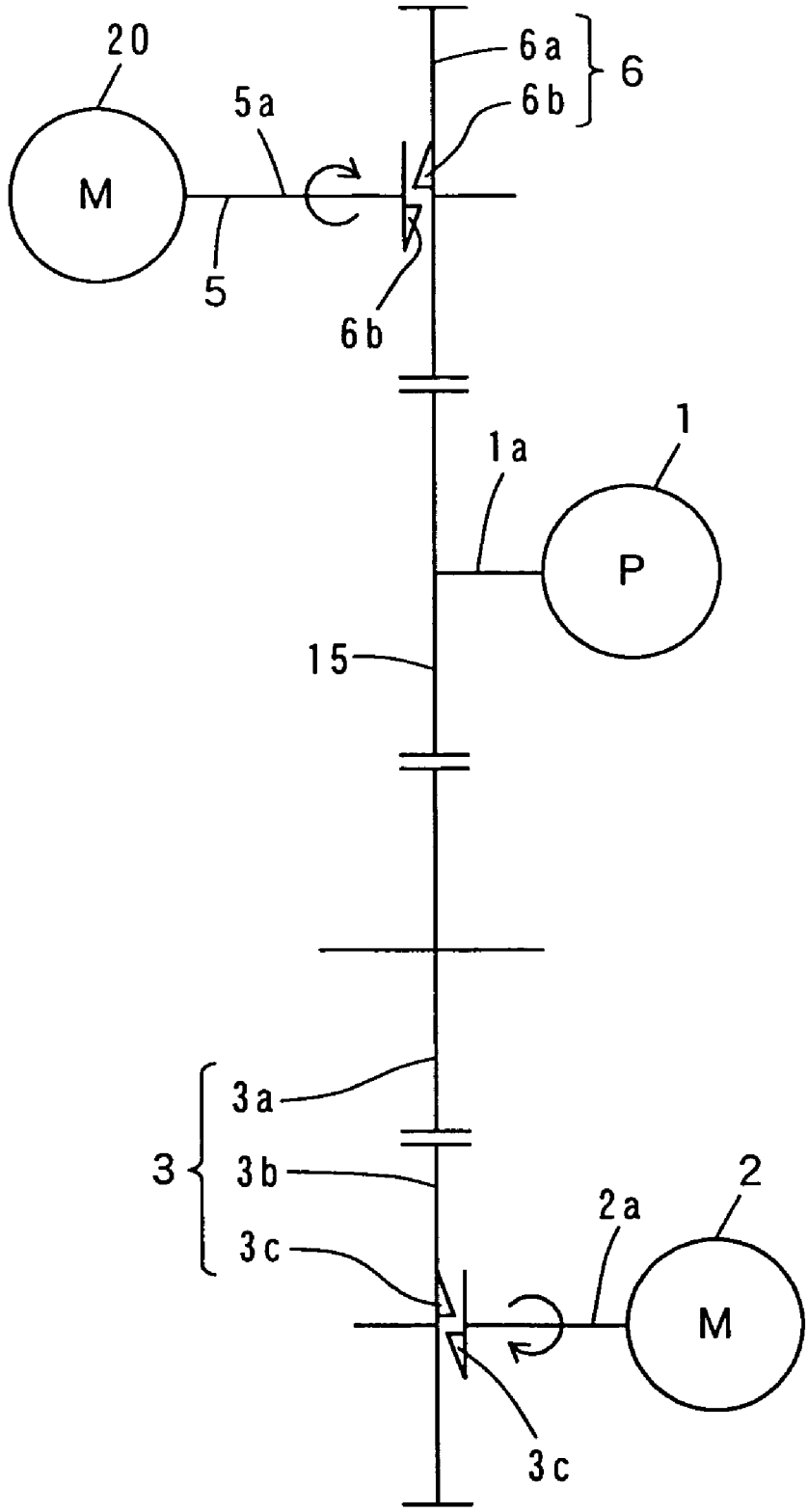
FIG. 3 is schematic diagram illustrating in detail the hydraulic valve driving device in the engine in FIG. 1.
Figure 4:
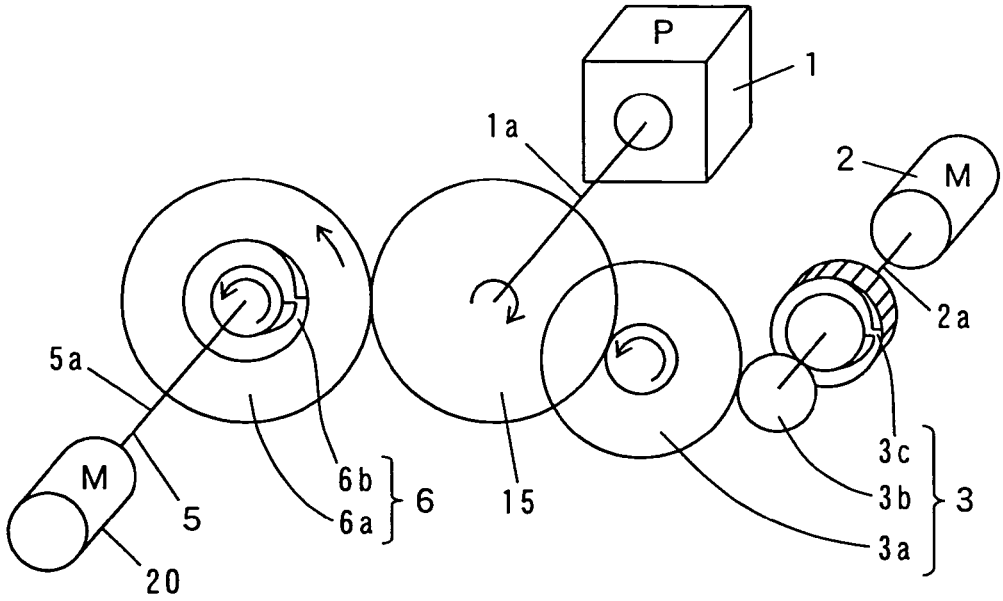
FIG. 4 is a schematic perspective view illustrating in detail the hydraulic valve driving device in the engine in FIG. 1.

FIG. 2 is a sectional view for use in illustrating in detail the hydraulic valve driving device in the engine in FIG. 1. FIG. 3 is a schematic view for use in illustrating in detail the hydraulic valve driving device in FIG. 1. FIG. 4 is a schematic perspective view for use in illustrating in detail the hydraulic valve driving device in the engine in FIG. 1.

As shown in FIGS. 2 to 4, the hydraulic pump 1 has a hydraulic pump shaft 1*a*. The hydraulic pump shaft 1*a* is provided with a pump-driven gear 15. The pump-driven gear 15 is connected to the motor shaft 2*a* of the hydraulic pump driving motor 2 through the transmission switching mechanism 3. The transmission switching mechanism 3 includes a pump idle gear 3*a*, a pump drive gear 3*b*, and a one-way clutch 3*c*.

The one-way clutch 3*c* transmits rotational force from the side of the hydraulic pump driving motor 2 to the side of the hydraulic pump 1 but not from the side of hydraulic pump 1 to the side of the hydraulic pump driving motor 2.

The pump driven gear 15 is connected to the crank shaft 5*a* of the crank 5 through the transmission switching mechanism 6. The transmission switching mechanism 6 includes a pump drive gear 6*a* and a one-way clutch 6*b*.

The one-way clutch 6*b* transmits rotational force from the side of the crank 5 to the side of the hydraulic pump 1 but not from the side of the hydraulic pump 1 to the side of the crank 5.

(1-3) Method of Controlling Hydraulic Valve Driving Device

Figure 5:
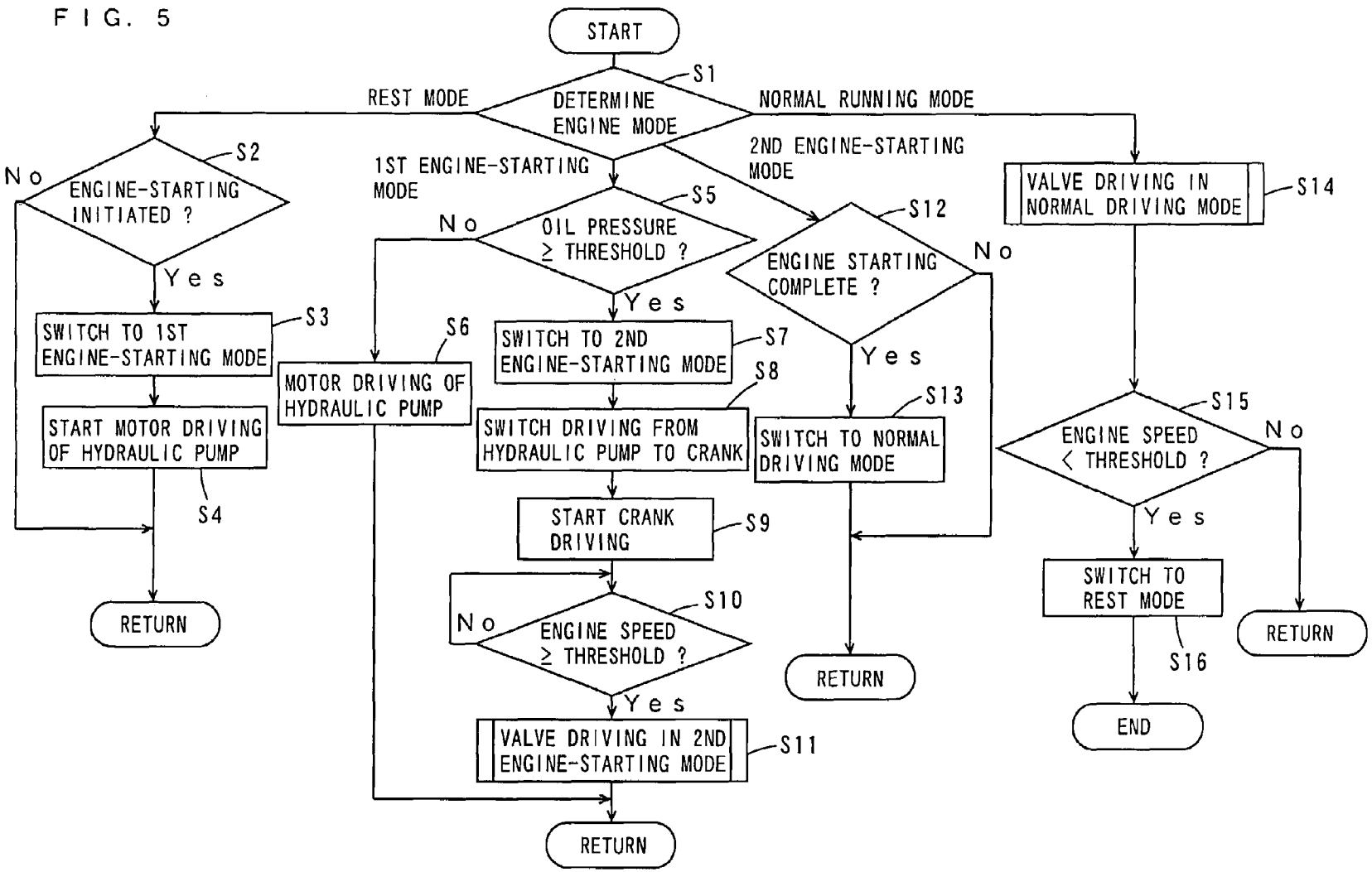
FIG. 5 is a flowchart illustrating a method of controlling the hydraulic valve driving device in the engine using the controller in FIG. 1.

FIG. 5 is a flowchart for use in illustrating a method of controlling a hydraulic valve driving device in the engine using the controller in FIG. 1. Now, with reference to FIGS. 1 to 5, the method of controlling the hydraulic valve driving device will be described in detail.

In the initial state, the engine mode is set to a rest mode. The controller 14 determines the engine mode (step S1). When the engine 100 is at rest, the controller 14 determines the engine mode as the rest mode and proceeds to processing in step S2.

Then, the controller 14 determines whether or not the engine 100 is in a starting start state (step S2). When the driver of the motorcycle turns on the main switch 150 and the starter switch 160 in FIG. 14 described later, the engine 100 attains a starting start state. If the engine 100 is not in the starting start state, the control returns to the processing in step S1.

When the engine 100 is in the starting start state, the controller 14 switches the engine mode to a first engine-starting mode (step S3) and starts to drive the hydraulic pump 1 (see FIG. 1) by the hydraulic pump driving motor 2 (see FIG. 1) (hereinafter referred to as "motor driving of the hydraulic pump 1") (step S4). The oil pressure increases by the motor driving of the hydraulic pump 1. Then, the controller returns to the processing in step S1.

The controller 14 proceeds to processing in step S5 upon determining the engine mode as the first engine-starting mode in step S1.

The controller 14 determines whether or not the oil pressure of the hydraulic pump 1 is a threshold or more based on the oil pressure signal OP from the oil pressure sensor 10 (see FIG. 1) (step S5). The threshold is set for example about in the range from 2 MPa to 3 MPa in advance.

If the oil pressure of the hydraulic pump 1 is less than the threshold, the controller 14 has the motor driving of the hydraulic pump 1 continued (step S6) and returns to the processing in step S1.

When the oil pressure of the hydraulic pump 1 is not less than the threshold in step S5, the controller 14 switches the engine mode from the first engine-starting mode to a second engine-starting mode (step S7). The controller 14 stops the hydraulic pump driving motor 2 and operates the starter motor 20 to switch the motor driving of the hydraulic pump 1 to driving of the hydraulic pump 1 by the crank 5 using the starter motor 20 (hereinafter referred to as crank driving of the hydraulic pump 1) (step S8), and the crank driving of the hydraulic pump 1 is started (step S9).

Now, the crank 5 is driven by the starter motor 20 in the second engine-starting mode, so that the rotational speed of the engine 100 increases.

The mechanical operation during the transition from the first engine-starting mode to the second engine-starting mode in steps S7 to S9 will be described later in detail.

The controller 14 then determines whether or not the rotational speed of the engine 100 is equal to or higher than the threshold based on the crank position signal CP from the crank position sensor 13 (step S10). In this case, the threshold is predetermined for example about in the range from 300 rpm to 400 rpm.

If the rotational speed of the engine 100 is less than the threshold, the controller 14 repeats the determination in step S10 until the rotational speed of the engine 100 becomes equal to or higher than the threshold.

If the rotational speed of the engine 100 is equal to or higher than the threshold, the controller 14 drives the engine valve 8 (see FIG. 1) in the second engine-starting mode in response to the valve control signal VC (step S11). Then, the controller proceeds to processing in step S1.

The controller 14 proceeds to processing in step S12 upon determining the engine mode as the second engine-starting mode in step S1.

The controller 14 determines whether or not the starting of the engine 100 is complete by ignition in the engine 100 (step S12). If the starting of the engine 100 is not complete, the controller returns to the processing in step S1.

If the starting of the engine 100 is complete, the controller 14 switches the engine mode from the second engine-starting mode to a normal running mode (step S13) and returns to the processing in step S1.

The controller 14 proceeds to processing in step S14 upon determining that the engine mode is the normal running mode in step S1.

The controller 14 drives the engine valve 8 (see FIG. 1) in the normal running mode in response to the valve control signal VC (step S14). In this case, the hydraulic pump 1 is driven by the rotation of the crank 5 in the engine 100, so that the engine valve 8 is operated.

Then, the controller 14 determines whether or not the rotational speed of the engine 100 is smaller than the threshold based on the crank position signal CP received from the crank position sensor 13 (step S15).

If the rotational speed of the engine 100 is not less than the threshold, the controller returns to the processing in step S1. Meanwhile, if the rotational speed of the engine 100 is less than the threshold in step S15, the engine mode is switched to a rest mode (step S16) and the process ends.

(1-4) Mechanical Operation during Transition from First Starting Mode to Second Engine-Starting Mode Now, with reference to FIGS. 2 to 4, the mechanical operation carried out during the transition from the first engine-starting mode to the second engine-starting mode in steps S7 to S9 will be described in detail.

In the first engine-starting mode, the rotational force of the motor shaft 2*a* of the hydraulic pump driving motor 2 is transmitted to the hydraulic pump shaft 1*a* of the hydraulic pump 1 through the one-way clutch 3*c*, the pump drive gear 3*b*, the pump idle gear 3*a*, and the pump driven gear 15.

At the time, the driving force of the hydraulic pump driving motor 2 is transmitted to the pump drive gear 6*a* through the hydraulic pump 1 and the pump driven gear 15. The driving force thus transmitted from the hydraulic pump driving motor 2 to the pump drive gear 6*a* is not transmitted to the side of the crank 5 because the one-way clutch 6*b* does not transmit the rotational force from the side of the hydraulic pump 1 to the side of crank 5.

During the transition from the first engine-starting mode to the second engine-starting mode, the hydraulic pump driving motor 2 stops and the crank shaft 5*a* of the crank 5 is driven by the starter motor 20. In this way, the rotational force of the crank shaft 5*a* is transmitted to the hydraulic pump shaft 1*a* of the hydraulic pump 1 through the one-way clutch 6*b*, the pump drive gear 6*a*, and the pump driven gear 15.

At the time, driving force by the crank 5 is transmitted to the pump idle gear 3*a* and the pump drive gear 3*b* through the hydraulic pump 1 and the pump driven gear 15. Meanwhile, the driving force thus transmitted from the crank 5 to the pump drive gear 3*b* is not transmitted to the hydraulic pump driving motor 2 because the one-way clutch 3*c* does not transmit the rotational force from the side of the hydraulic pump 1 to the side of the hydraulic pump driving motor 2.

In this way, the transition from the first engine-starting mode to the second engine-starting mode in steps S7 to S9 in FIG. 5 is carried out.

(1-5) Operation of Piston and Engine Valve in Hydraulic Valve Driving Device

Now, with reference to FIG. 6, the operation of the piston 4 (crank 5) and the engine valve 8 (intake and exhaust valves) in steps S7 to S14 in FIG. 5 will be described.

Figure 6:
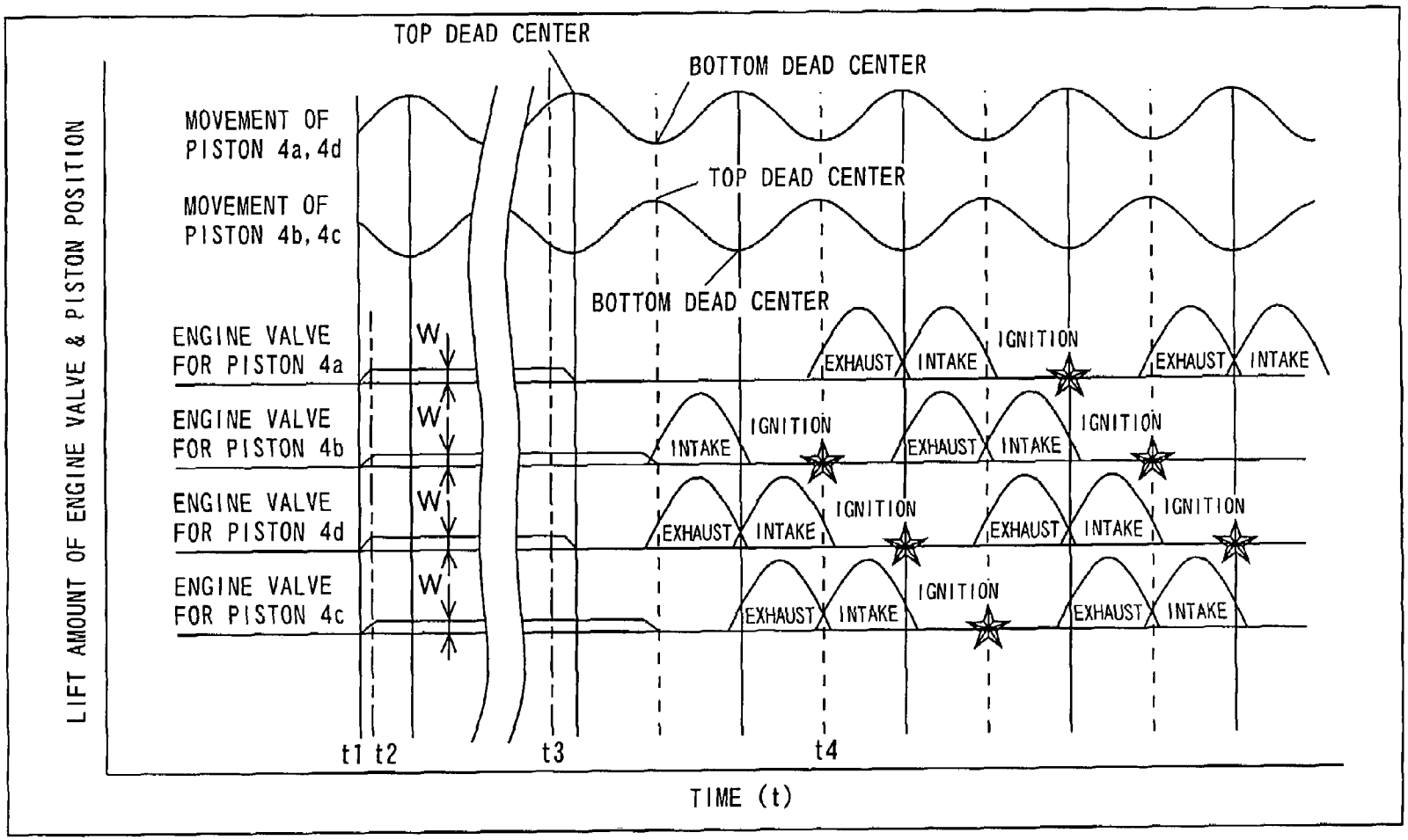
FIG. 6 is a chart illustrating the operation of the piston and the engine valve in the hydraulic valve driving device in the engine in FIG. 1.

FIG. 6 is a chart for use in illustrating the operation of the piston and the engine valve in the hydraulic valve driving device in the engine in FIG. 1. The ordinate in FIG. 6 represents the position of the pistons 4*a* to 4*d* in the cylinder and the lift amount of the engine valve 8.

When cranking starts in response to the transition from the first engine-starting mode to the second engine-starting mode at time t1 in FIG. 6, at least one of the intake valve and the exhaust valve in each of the four cylinders is opened at time t2 almost without delay. In this case, the engine valve 8 is opened with the maximum lift amount W so that it does not collide against the pistons 4*a* to 4*d*.

After the engine valve 8 is opened and before the cranking in the second engine-starting mode ends, the maximum lift amounts W of the intake valve and the exhaust valve are kept constant.

Note that as more engine valves 8 (intake and exhaust valves) are opened, the pump loss can be reduced more, but more energy is necessary to allow these engine valves 8 to operate. Therefore, the number of engine valves 8 to be opened must be set in consideration of these points.

At time t3, the rotational speed of the engine 100 is equal to or higher than the threshold (about in the range from 300 rpm to 400 rpm) by cranking in the second engine-starting mode, and the engine valves 8 of the cylinders close sequentially when their pistons 4*a* to 4*d* reach top dead center.

Ignition starts in the cylinders in the order in which the cylinders start injecting intake air and fuel, and the engine valve 8 is driven in the normal mode, which operates the engine 100. At time t4 in the example in FIG. 6, a fuel-air mixture in the cylinder having the piston 4*b* is ignited, so that the second engine-starting mode is switched to the normal running mode. In the normal running mode, the hydraulic pump 1 (see FIG. 1) is driven by the rotational force of the crank 5 generated by the operation of the engine 100.

(1-6) Advantages of First Preferred Embodiment

According to the first preferred embodiment, at the time of engine starting, the hydraulic pump 1 is driven by the hydraulic pump driving motor 2 in the first engine-starting mode while the crank 5 is at rest, and then in the second engine-starting mode, the hydraulic pump 1 is driven by driving by the crank 5 using the starter motor 20. In the driving of the hydraulic pump 1 by the hydraulic driving motor 2, the rotational speed more quickly rises and the energy for driving is smaller in comparison with the driving by the crank 5. In this way, in the first engine-starting mode at the time of engine starting, the time before the oil pressure of the hydraulic pump 1 rises can be shortened and the energy for driving the hydraulic pump 1 can be reduced. Therefore, more quick and improved engine starting can be carried out with reduced energy.

According to the first preferred embodiment, during the operation in the first engine-starting mode, when the oil pressure of the hydraulic pump 1 reaches a prescribed value (threshold) or higher, the engine mode is switched from the first engine-starting mode to the second engine-starting mode. In this way, the crank 5 is driven in the second engine-starting mode while the oil pressure of the hydraulic pump 1 is raised. Therefore, if driving by the crank 5 (cranking) is carried out, the operation of the engine valve 8 can be prevented from being unstable. The cranking can be initiated in the second engine-starting mode while the oil pressure is raised to such a level that the engine valve 8 (intake and exhaust valves) can be driven stably. Therefore, the engine 100 can be started shortly after the start of cranking.

According to the first preferred embodiment, the one-way clutch 3*c* is provided to transmit rotational force from the side of the hydraulic pump driving motor 2 to the side of the hydraulic pump 1 but not from the side of the hydraulic pump 1 to the side of the hydraulic pump driving motor 2, and the one-way clutch 6*b* is provided to transmit rotational force from the side of the crank 5 to the side of the hydraulic pump 1 but not from the side of the hydraulic pump 1 to the side of the crank 5.

In this way, in the first engine-starting mode, the driving force by the hydraulic pump driving motor 2 can be prevented from being transmitted to the crank 5 through the hydraulic pump 1 by the function of the one-way clutch 6*b*. Consequently, in the first engine-starting mode, the hydraulic pump 1 can be driven by the hydraulic pump driving motor 2 while the crank 5 is not.

In the second engine-starting mode, the driving force from the crank 5 can be prevented from being transmitted to the hydraulic pump driving motor 2 through the hydraulic pump 1 by the function of the one-way clutch 3*c*.

According to the first preferred embodiment, at the time of cranking in the second engine-starting mode, the hydraulic valve driving device is controlled so that at least one of the intake and exhaust valves in each of the four cylinders is opened. In this way, in the second engine-starting mode at the time of cranking, the cylinder can be prevented from being sealed, so that the pressure of compressed air in the cylinder can be prevented from increasing while the piston 4 operates. Therefore, the torque for driving the crank 5 can be reduced, and the rotational speed of the engine 100 can be increased in a shorter time. As a result, more quick and improved engine starting can be carried out.

According to the first preferred embodiment, at the time of cranking in the second engine-starting mode, the hydraulic valve driving device is controlled so that at least one of the intake and exhaust valves in each of the four cylinders is opened with such a lift amount that the valve does not collide against the piston 4. Therefore, at the time of cranking in the second engine-starting mode, the engine valve 8 and the piston 4 can be prevented from colliding against each other, while the torque for driving the crank 5 can be reduced.

According to the first preferred embodiment, after at least one of the intake and exhaust valves in each of the four cylinders is opened and before the cranking ends, the lift amount W of the opened engine valve 8 is kept constant. In this way, at the time of cranking, it is not necessary to change the lift amount W of the engine valve 8 while the engine valve 8 is opened, and therefore energy can be prevented from being consumed for the purpose of changing the lift amount W.

(2) Second Preferred Embodiment (2-1) Structure of Engine

Figure 7:
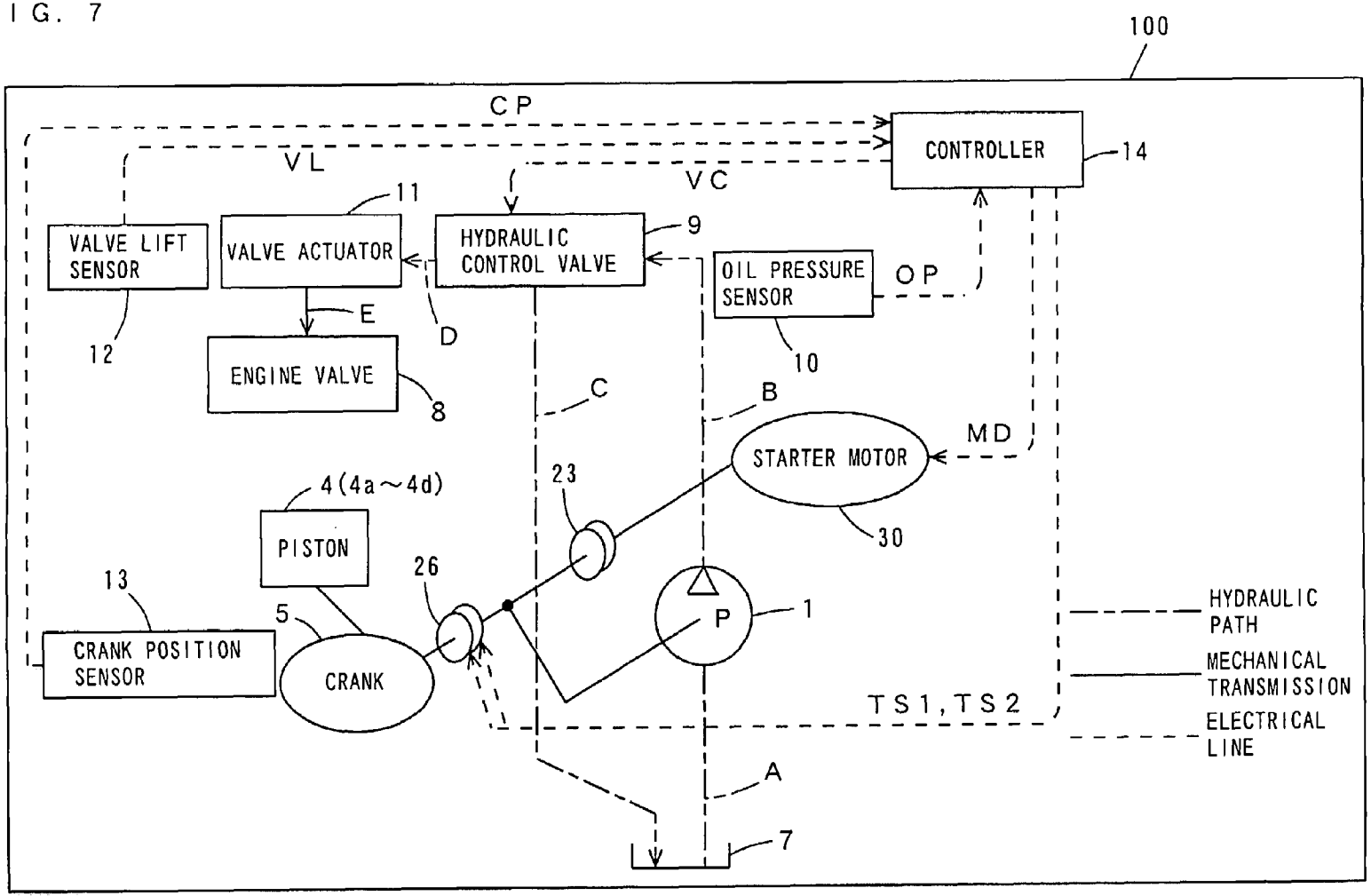
FIG. 7 is a schematic diagram of a general structure of a hydraulic valve driving device in an engine according to a second preferred embodiment of the invention.

FIG. 7 is a schematic view of a general structure of a hydraulic valve driving device in an engine according to a second preferred embodiment of the invention.

According to the second preferred embodiment, differently from the first preferred embodiment, the hydraulic pump 1 is driven in the first engine-starting mode by a starter motor 30 that drives the crank 5.

As shown in FIG. 7, similarly to the first preferred embodiment, the hydraulic valve driving device in an engine 100 according to the second preferred embodiment includes a hydraulic pump 1, an oil tank 7, an engine valve 8 including an intake valve and an exhaust valve, a hydraulic control valve 9 that switches between hydraulic paths to control oil pressure, an oil pressure sensor 10 that detects oil pressure, a valve actuator 11 that drives the engine valve 8 by oil pressure, a valve lift sensor 12 that detects the lift amount of the engine valve 8, a crank position sensor 13 that detects the crank angle of the crank 5, and a controller 14.

Differently from the first preferred embodiment, the hydraulic valve driving device according to the second preferred embodiment includes a starter motor 30, and transmission switching mechanisms 23 and 26. The starter motor 30 drives the hydraulic pump 1 and carries out cranking at the time of starting of the engine 100. The starter motor 30 is operated when a starter switch that is not shown is pressed. The transmission switching mechanism 23 transmits the driving force from the starter motor 30 to the hydraulic pump 1. The transmission switching mechanism 26 transmits the driving force from the crank 5 coupled to the piston 4 to the hydraulic pump 1.

The controller 14 applies the motor driving signal MD to the starter motor 30 and transmission signals TS1 and TS2 to the switching clutches 26*a* and 26*e* (see FIG. 8) respectively of the transmission switching mechanism 26.

(2-2) Structure of Hydraulic Valve Driving Device

Figure 8:
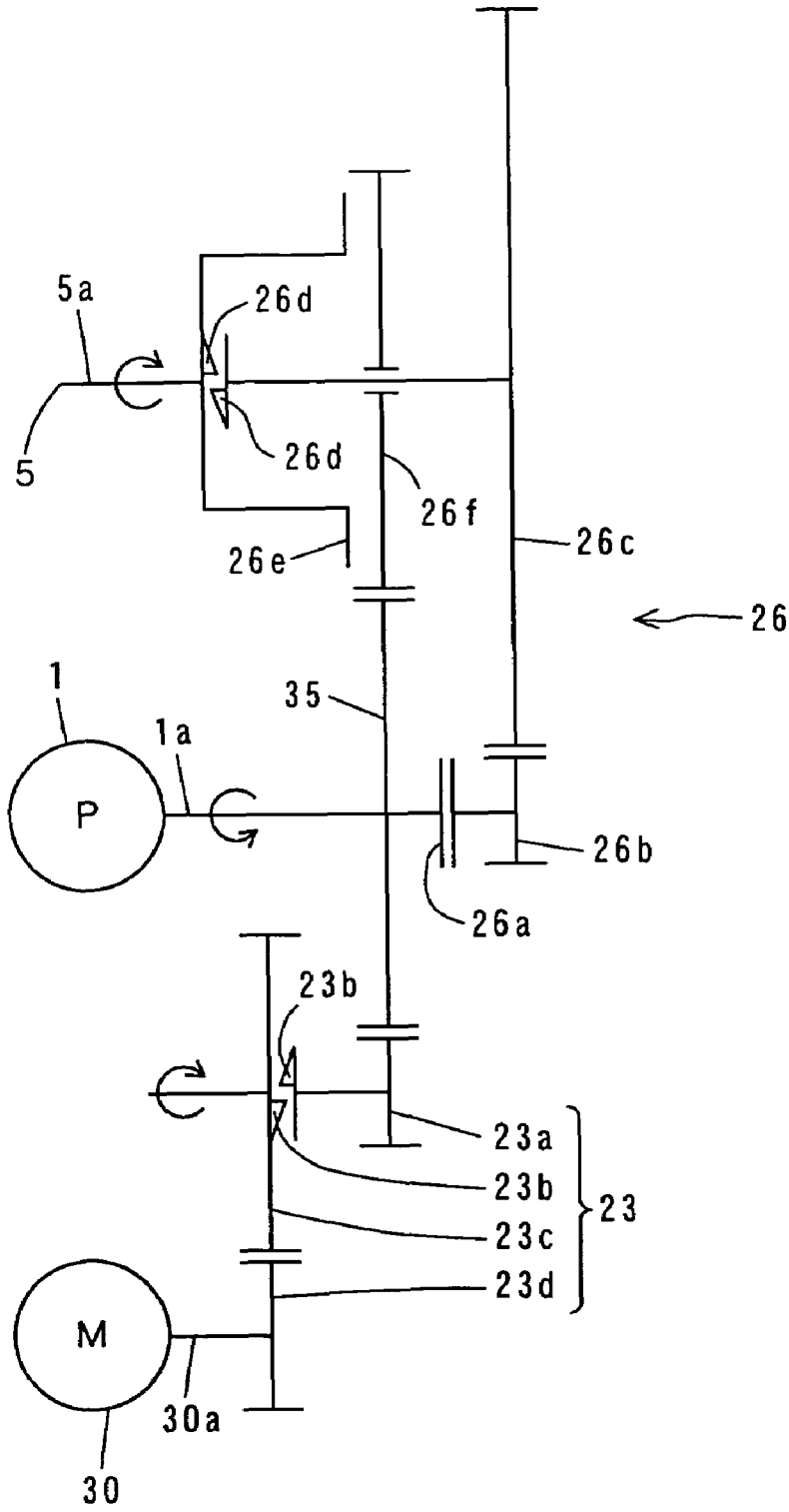
FIG. 8 is a schematic diagram illustrating in detail the hydraulic valve driving device in the engine in FIG. 7.

FIG. 8 is a schematic view for use in illustrating in detail the hydraulic valve driving device in the engine in FIG. 7.

As shown in FIG. 8, according to the second preferred embodiment, a pump driven gear 35 is attached to the hydraulic pump shaft 1*a* of the hydraulic pump 1. The pump driven gear 35 is connected to the motor shaft 30*a* of the starter motor 30 through the transmission switching mechanism 23. The transmission switching mechanism 23 includes a pump idle gear 23*a*, a one-watch clutch 23*b*, a pump idle gear 23*c*, and a pump drive gear 23*d*. The starter motor 30 is connected with the starter switch 160 in FIG. 14 that will be described.

The one-way clutch 23*b* transmits rotational force from the side of the starter motor 30 to the side of the hydraulic pump 1 but not from the side of the hydraulic pump 1 to the side of the starter motor 30.

The pump driven gear 35 is connected to the crank shaft 5*a* of the crank 5 through one rotational transmission path including a switching clutch 26*a*, a pump drive gear 26*b*, a pump driven gear 26*c*, and a one-way clutch 26*d*. The crank shaft 5*a* of the crank 5 is connected to the pump driven gear 35 through the other rotational transmission path including a switching clutch 26*e* and a pump drive gear 26*f*.

The transmission switching mechanism 26 includes the switching clutch 26*a*, the pump driven gear 26*b*, the pump drive gear 26*c*, the one-way clutch 26*d*, the switching clutch 26*e* and the pump drive gear 26*f*.

The one-way clutch 26*d* transmits rotational force from the side of the pump drive gear 26*c* to the side of the crank 5 but not from the side of the crank 5 to the side of the pump drive gear 26*c*.

Note that the other structure of the second preferred embodiment is the same as that of the first preferred embodiment and therefore will not be described.

(2-3) Mechanical Operation during Transition from First Engine-Starting Mode to Second Engine-Starting Mode Now, referring to FIGS. 7 and 8, mechanical operation during transition from the first engine-starting mode to the second engine-starting mode will be described.

In the first engine-starting mode, the rotational force of the motor shaft 30*a* of the starter motor 30 is transmitted to the hydraulic pump shaft 1*a* of the hydraulic pump 1 through the pump drive gear 23*d*, the pump idle gear 23*c*, the one-way clutch 23*b*, the pump idle gear 23*a*, and the pump driven gear 35. At the time, the rotational force of the starter motor 30 is transmitted to the pump drive gear 26*f* through the hydraulic pump 1 and the pump driven gear 35. Meanwhile, the switching clutches 26*a* and 26*e* are disconnected, so that the rotational force of the starter motor 30 is not transmitted to the crank shaft 5*a* of the crank 5.

During the transition from the first engine-starting mode to the second engine-starting mode, the switching clutch 26*a* is connected, so that the rotational force of the motor shaft 30*a* of the starter motor 30 is transmitted to the switching clutch 26*a*, the pump driven gear 26*b*, the pump drive gear 26*c*, the one-way clutch 26*d*, and the crank 5 through the hydraulic pump 1 and the pump driven gear 35. This starts cranking.

In this case, the rotational speed of the crank 5 is reduced so that the rotation number of the hydraulic pump 1 and the rotation number of the crank 5 are set about in a ratio of 10:3.

Then, once the rotational speed of the engine 100 is equal to or higher than a threshold, the engine valve 8 (see FIG. 7) is driven in a normal manner, and the engine 100 is operated. The threshold is set in advance for example about in the range from 300 rpm to 400 rpm. The switching clutch 26*a* is disconnected, and the switching clutch 26*e* is connected. In this way, the rotational force of the crank 5 is transmitted to the hydraulic pump 1 through the switching clutch 26*e*, the pump drive gear 26*f* and the pump driven gear 35. At the time, the rotational force of the crank 5 is not transmitted to the pump drive gear 26*c* because the one-way clutch 26*d* does not transmit the rotational force of the crank 5 to the pump drive gear 26*c*.

The rotational force of the crank 5 is transmitted to the pump idle gear 23*a* through the hydraulic pump 1 and the pump driven gear 35. Meanwhile, the rotational force transmitted to the pump idle gear 23*a* is not transmitted to the starter motor 30 because the one-way clutch 23*b* does not transmit the rotational force from the side of the hydraulic pump 1 to the side of the starter motor 30. In this case, the rotational speed of the hydraulic pump 1 is reduced so that the ratio of the rotation number of the crank 5 and the rotation number of the hydraulic pump 1 is set about in the range from 10:7 to 10:10. In this way, the first engine-starting mode is switched to the second engine-starting mode.

(2-4) Advantages of Second Preferred Embodiment

As described above, according to the second preferred embodiment, in the first engine-starting mode, the hydraulic pump 1 is driven by the starter motor 30 that drives the crank 5. In this way, it is not necessary to provide an additional dedicated motor for driving the hydraulic pump 1 in the first engine-starting mode. Therefore, when the hydraulic pump 1 is driven by the starter motor 30, the number of parts does not increase.

According to the second preferred embodiment, in the first engine-starting mode, the switching clutches 26*a* and 26*e* provided in two rotational transmission paths between the hydraulic pump 1 and the crank 5 are disconnected, so that driving force from the starter motor 30 can be prevented from being transmitted to the crank 5 through the hydraulic pump 1. In this way, in the first engine-starting mode, the hydraulic pump 1 can be driven by the starter motor 30 while the crank 5 is not.

The one-way clutch 23*b* is provided to transmit the rotational force from the side of the starter motor 30 to the side of the hydraulic pump 1 but not from the side of the hydraulic pump 1 to the side of the starter motor 30. Therefore, in the second engine-starting mode, the driving force of the crank 5 can be prevented from being transmitted to the starter motor 30 through the hydraulic pump 1.

A rotational transmission path for transmitting driving force from the hydraulic pump 1 to the crank 5 and a rotational transmission path for transmitting driving force from the crank 5 to the hydraulic pump 1 are provided. In this way, the hydraulic pump 1 and the crank 5 can be connected by the two rotational transmission paths and therefore the speed ratios of the transmission paths can be set independently of each other. More specifically, when the crank 5 is driven through the hydraulic pump 1 by driving force from the starter motor 30 at the time of cranking, the speed of the crank 5 can be reduced so that the ratio of the rotation number of the hydraulic pump 1 and the rotation number of the crank 5 at one of the transmission paths is about 10:3. When the crank 5 is driven by driving force from the engine 100 in the normal running mode, the speed of the crank 5 can be reduced so that the ratio of the rotation number of the crank 5 and the rotation number of the hydraulic pump 1 at the other transmission path is about in the range from 10:7 to 10:10.

Note that other advantages of the second preferred embodiment are the same as those of the first preferred embodiment. More specifically, according to the second preferred embodiment similarly to the first preferred embodiment, at the time of engine starting, after the hydraulic pump 1 is driven by the starter motor 30 in the first engine-starting mode, the crank 5 and the hydraulic pump 1 are driven by the starter motor 30 in the second engine-starting mode. Therefore, more quick and improved engine starting can be carried out with reduced energy.

(3) Third Preferred Embodiment

Now, a hydraulic valve driving device in an engine according to a third preferred embodiment of the invention will be described.

(3-1) Mechanical Operation during Transition from First Engine-Starting Mode to Second Engine-Starting Mode The structure of the hydraulic valve driving device according to a third preferred embodiment is the same as that of the first or second preferred embodiment.

According to the third preferred embodiment, differently from to the first and second preferred embodiments, the hydraulic pump 1 is started when a main switch 150 in FIG. 14 that will be described later is turned on.

Figure 9:
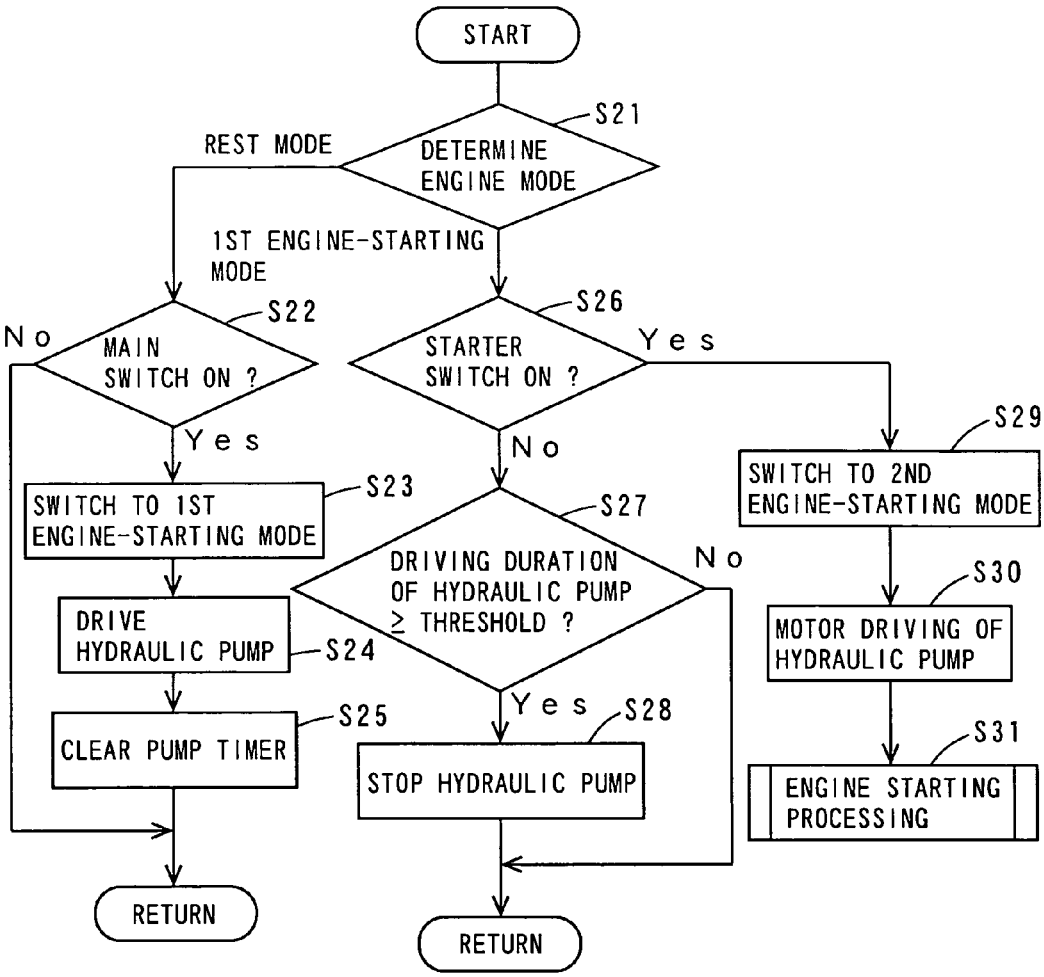
FIG. 9 is a flowchart illustrating a method of controlling a hydraulic valve driving device according to a third preferred embodiment of the invention.

FIG. 9 is a flowchart for use in illustrating a method of controlling a hydraulic valve driving device according to the third preferred embodiment of the invention. Now, with reference to FIGS. 1, 7, and 9, the method of controlling a hydraulic valve driving device in an engine according to the third preferred embodiment will be described in detail.

In the initial state, the engine mode is set to a rest mode. The controller 14 determines the engine mode (step S21). When the engine 100 is at rest, the controller 14 determines that the engine mode is in the rest mode and proceeds to processing in step S22.

The controller 14 then determines whether or not the main switch 150 has been turned on by the driver of the motorcycle (step S22). If the main switch 150 is not on, the controller returns to the processing in step S21.

If the main switch 150 is on, the controller 14 switches the engine mode to the first engine-starting mode (step S23), and the hydraulic pump 1 is driven by the hydraulic pump driving motor 2 (for the same structure as that of the first preferred embodiment in FIG. 1) or the starter motor 30 (for the same structure as that of the second preferred embodiment in FIG. 7) (step S24).

Then, the controller 14 resets a built-in pump timer to "0" (step S25). In this way, the pump timer starts counting the driving duration of the hydraulic pump 1. The controller then returns to the processing in step S21.

The controller 14 proceeds to processing in step S26 upon determining that the engine mode is the first engine-starting mode in step S21.

The controller 14 then determines whether or not the starter switch 160 has been turned on by the driver of the motorcycle (step S26). If the starter switch 160 is not on, the controller 14 determines whether or not the driving duration of the hydraulic pump 1 counted by the pump timer is equal to or higher than a threshold (step S27). If the driving duration of the hydraulic pump 1 is less than the threshold, the controller 14 returns to the processing in step S21.

If the driving duration of the hydraulic pump 1 is equal to or higher than the threshold in step S27, the controller 14 stops driving the hydraulic pump 1 (step S28) and returns to the processing in step S21.

If the starter switch 160 is on in step S26, the controller 14 switches the engine mode from the first engine-starting mode to the second engine-starting mode (step S29). The controller 14 drives the hydraulic pump 1 by the starter motor 20 (for the same structure as that of the first preferred embodiment in FIG. 1) or the starter motor 30 (for the same structure as that of the second preferred embodiment in FIG. 7) ("motor-driving of the hydraulic pump 1") (step S30). The controller 14 then starts the engine 100 (step S31).

Note that the method of controlling the engine 100 at the time of engine starting after step S31 is the same as that of the first and second preferred embodiments.

(3-2) Advantages of Third Preferred Embodiment

As described above, according to the third preferred embodiment, the first engine-starting mode to drive the hydraulic pump 1 by the hydraulic pump driving motor 2 or the starter motor 30 is started in response to turning on of the main switch 150. In this way, before the driver turns on the starter switch 160, the hydraulic pump 1 is driven in advance by turning on the main switch 150, and the oil pressure of the hydraulic pump 1 is raised in advance. Therefore, the time after the driver turns on the starter switch 160 and before the engine mode is switched to the second engine-starting mode can be reduced. Consequently, more quick and improved engine starting can be carried out.

According to the third preferred embodiment, after the start of the first engine-starting mode, if the driving duration of the hydraulic pump 1 is equal to or higher than a prescribed period (threshold), and cranking is yet to be started, driving of the hydraulic pump 1 is stopped. In this way, if the driver turns on the main switch 150 and then does not turn on the starter switch 160, electric power is not wasted by driving the hydraulic pump driving motor 2 or the starter motor 30. Therefore, the battery can be prevented from being completely discharged.

Note that the other advantages of the third preferred embodiment are the same as those of the first and second preferred embodiments. According to the third preferred embodiment, similarly to the first and second preferred embodiments, after the hydraulic pump 1 is driven by the hydraulic pump driving motor 2 or the starter motor 30 in the first starter mode at the time of engine starting, the crank 5 and the hydraulic pump 1 are driven in the second engine-starting mode. In this way, more quick and improved engine starting can be carried out with reduced energy.

(4) Fourth Preferred Embodiment

Figure 10:
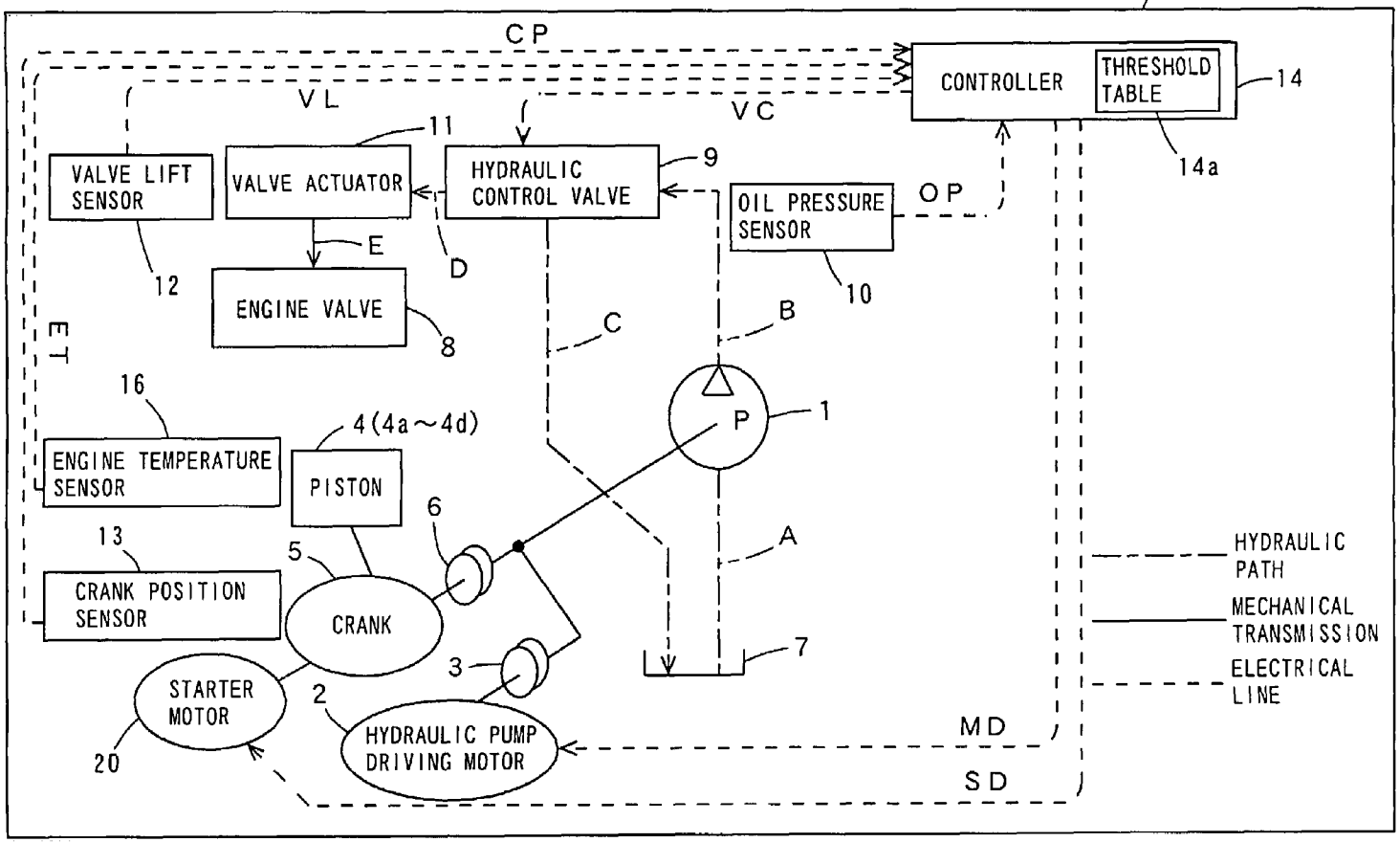
FIG. 10 is a schematic diagram of a general structure of a hydraulic valve driving device in an engine according to a fourth preferred embodiment of the invention.
Figure 11:
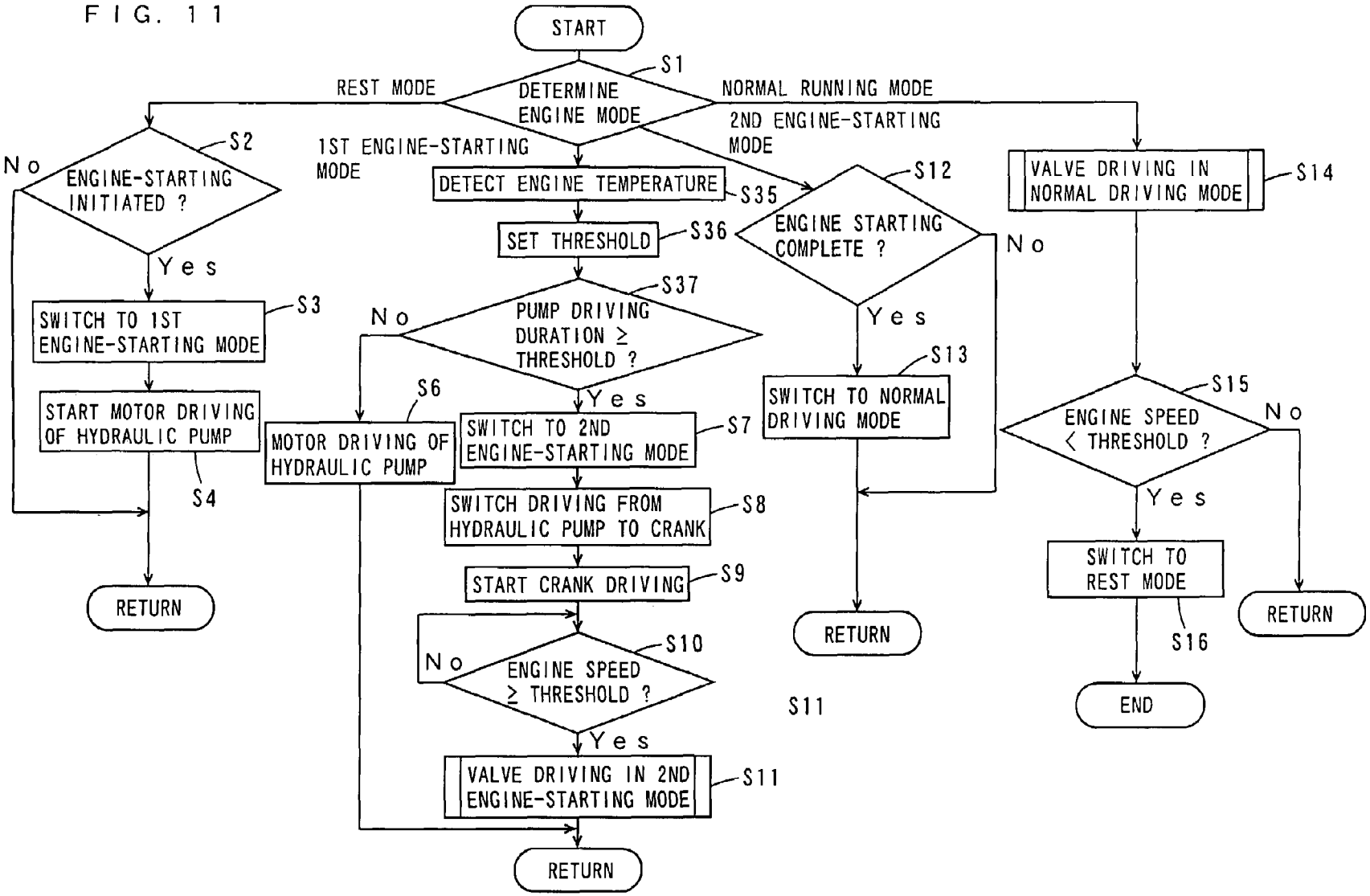
FIG. 11 is a flowchart illustrating a method of controlling the hydraulic valve driving device in the engine using the controller in FIG. 10.

FIG. 10 is a schematic view of a general structure of a hydraulic valve driving device in an engine according to a fourth preferred embodiment of the invention. FIG. 11 is a flowchart for use in illustrating a method of controlling the hydraulic valve driving device in the engine using the controller in FIG. 10.

In FIG. 10, the control 14 stores the relation between the temperature of the hydraulic pump 1 and the threshold for the driving duration of the hydraulic pump 1 in a threshold table 14*a*. An engine temperature sensor 16 that detects the temperature of the engine 100 is provided in the vicinity of the piston 4. The controller 14 is provided with engine temperature information ET indicating the temperature of the engine 100 from the engine temperature sensor 16.

If transition from the first engine-starting mode to the second engine-starting mode is carried out when the driving duration of the hydraulic pump 1 is equal to or higher than a threshold, the controller 14 may set the threshold based on the engine temperature information ET provided from the engine temperature sensor 16.

In this way, the controller 14 detects the temperature of the engine 100 based on the engine temperature information ET from the engine temperature sensor 16 (step S35 in FIG. 11). The controller 14 sets a threshold for the driving duration of the hydraulic pump 1 by referring to the threshold table 14*a* (step S36). The controller 14 then determines whether or not the driving duration of the hydraulic pump 1 is equal to or higher than the threshold (step S37).

At the time, if the temperature of the engine 100 is low, the viscosity of operating oil is high and there is high fluid resistance, so that it takes long before oil pressure necessary for driving the engine valve 8 is provided, which also increases the cumulative rotation number of the hydraulic pump 1.

Therefore, when the temperature of the engine 100 is high, the threshold (prescribed driving duration) is set short, while when the temperature of the engine 100 is low, the threshold (prescribed driving duration) is set large. In this way, the mode can be switched from the first engine-starting mode to the second engine-starting mode in closer timing to the transition from the first engine-starting mode to the second engine-starting mode by detecting the oil pressure of the hydraulic pump 1. Therefore, when the first engine-starting mode is switched to the second engine-starting mode based on the driving duration of the hydraulic pump 1, the operation of the engine valve 8 (intake and exhaust valves) can readily be prevented from being unstable.

Note that, according to the preferred embodiment, the temperature of the engine 100 can be detected by measuring the water temperature in the engine or the temperature of the piston 4.

(5) Fifth Preferred Embodiment

Figure 12:
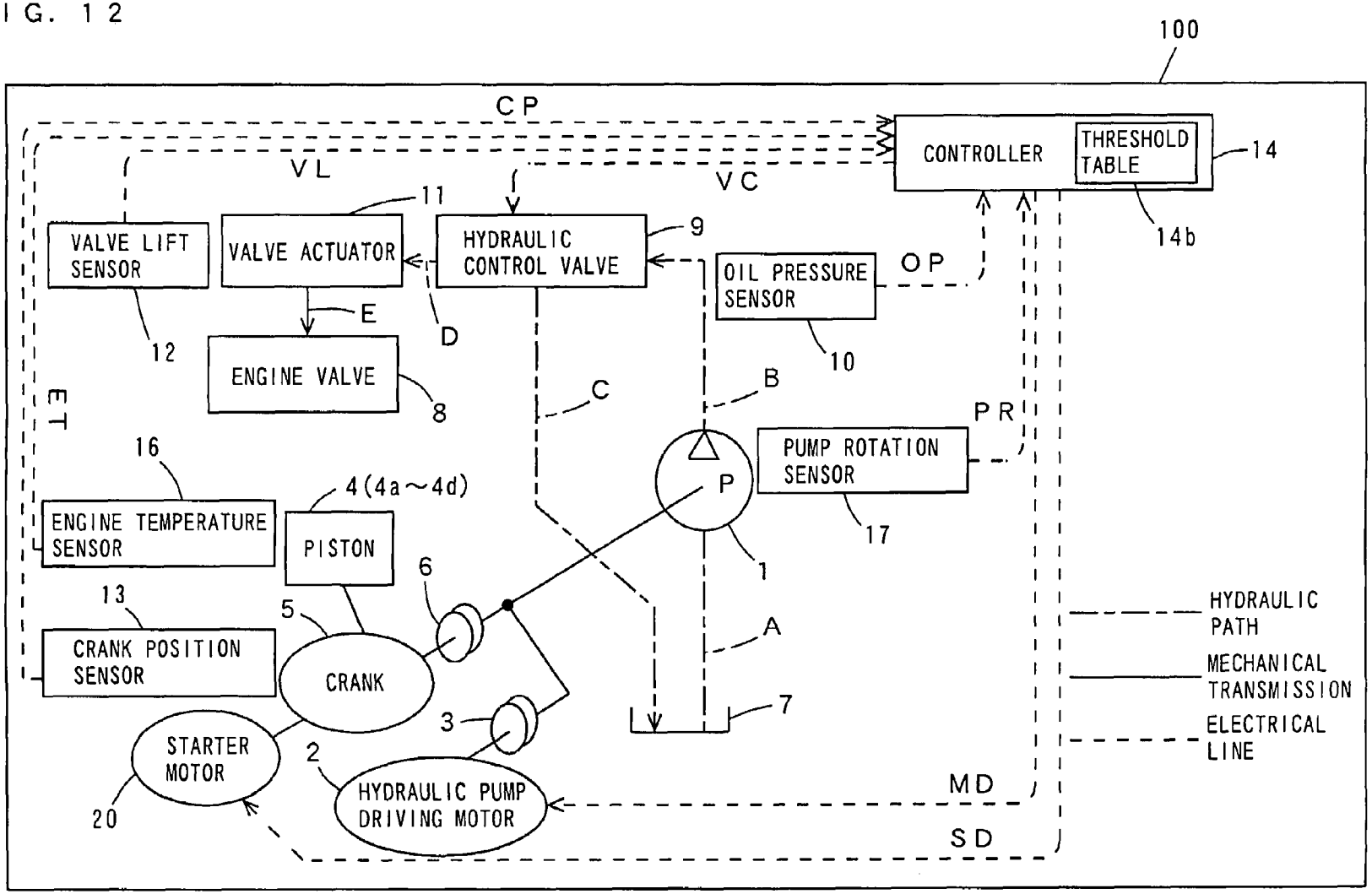
FIG. 12 is a schematic diagram of a general structure of a hydraulic valve driving device in an engine according to a fifth preferred embodiment of the invention.
Figure 13:
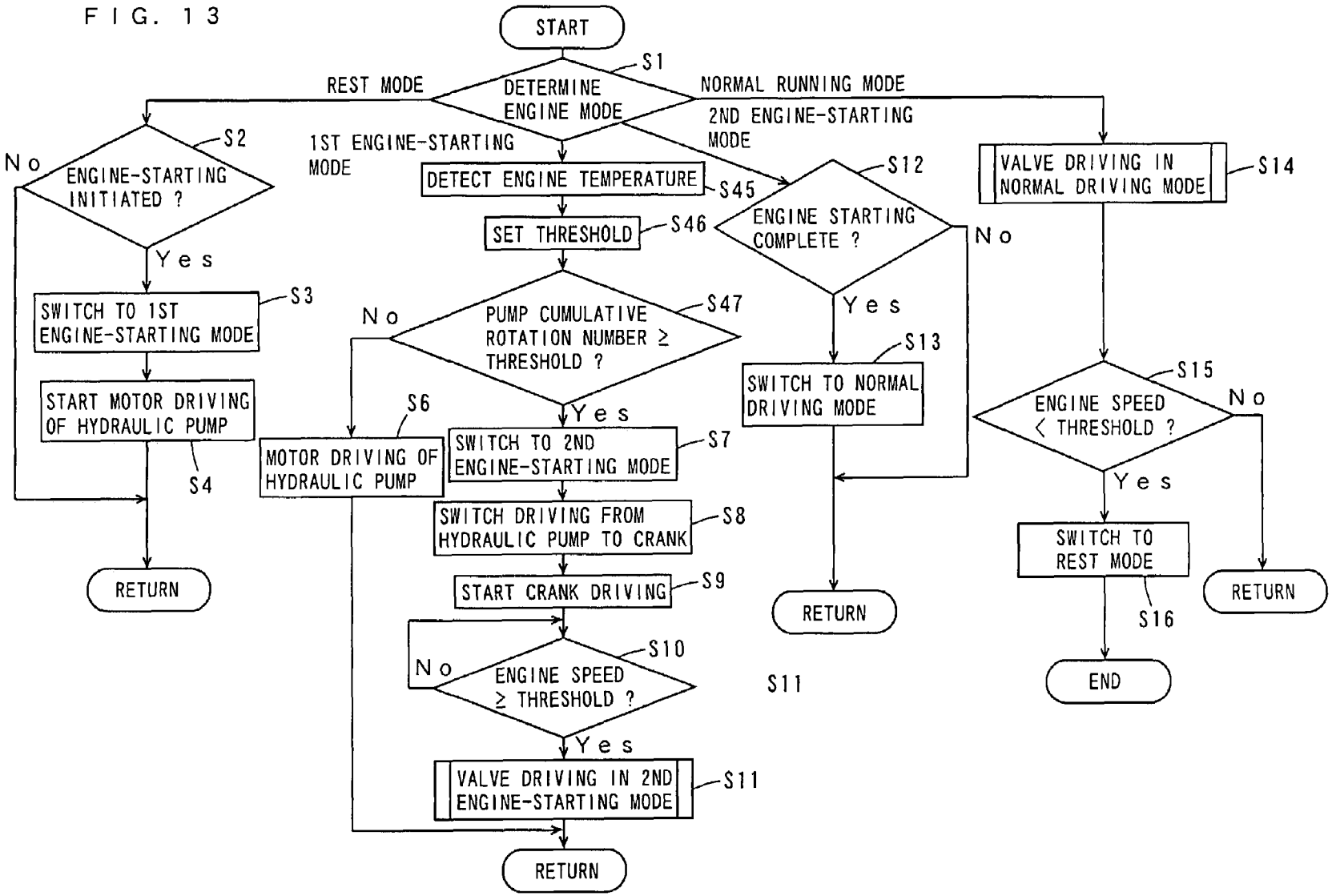
FIG. 13 is a flowchart illustrating a method of controlling the hydraulic valve driving device in the engine using the controller in FIG. 12.

FIG. 12 is a schematic view of a general structure of a hydraulic valve driving device in an engine according to a fifth preferred embodiment of the invention. FIG. 13 is a flowchart for use in illustrating a method of controlling a hydraulic valve driving device in an engine using the controller in FIG. 12.

As shown in FIG. 12, the controller 14 stores the relation between the temperature of the hydraulic pump 1 and the threshold for the cumulative rotation number (cumulative driving number) of the hydraulic pump 1 in the threshold table 14*b*. An engine temperature sensor 16 that detects the temperature of the engine 100 is provided in the vicinity of the piston 4. A pump rotation sensor 17 that detects the rotation number of the hydraulic pump 1 is provided in the vicinity of the hydraulic pump 1. The controller 14 is provided with engine temperature information ET indicating the temperature of the engine 100 from the engine temperature sensor 16 and with the pump rotation number signal PR indicating the rotation number of the hydraulic pump 1 from the pump rotation sensor 17.

When the first engine-starting mode is switched to the second engine-starting mode in response to the cumulative rotation number of the hydraulic pump 1 being equal to or higher than the threshold, the controller 14 can set the threshold based on the engine temperature information ET applied from the engine temperature sensor 16.

In this case, the controller 14 detects the temperature of the engine 100 based on the engine temperature information ET from the engine temperature sensor 16 (step S45 in FIG. 13). The controller 14 sets a threshold for the cumulative rotation number of the hydraulic pump 1 by referring to the threshold table 14*b* (step S46). The controller 14 then determines whether or not the cumulative rotation number of the hydraulic pump 1 is equal to or higher than the threshold based on the pump rotation number signal PR from the pump rotation sensor 17 (step S47).

Rather than providing the pump rotation sensor 17 for detecting the cumulative rotation number of the hydraulic pump 1, the cumulative rotation number of the hydraulic pump 1 may be calculated for example by detecting the pulsation of the oil pressure by the oil pressure sensor 10.

In this case, when the temperature of the engine 100 is low, the operating oil has high viscosity and therefore the fluid resistance is high. Therefore, it takes long before achieving necessary oil pressure for driving the engine valve 8, and the cumulative rotation number of the hydraulic pump 1 increases.

Therefore, if the temperature of the engine 100 is high, the threshold (prescribed cumulative rotation number) is set small, and if the temperature of the engine 100 is low, the threshold (prescribed cumulative rotation number) is set high. In this way, the first engine-starting mode can be switched to the second engine-starting mode in closer timing to the transition from the first engine-starting mode to the second engine-starting mode by detecting the oil pressure of the hydraulic pump 1. Therefore, when the first engine-starting mode is switched to the second engine-starting mode based on the cumulative rotation number of the hydraulic pump 1, the operation of the engine valve 8 (intake and exhaust valves) can readily be prevented from being unstable.

Note that according to the preferred embodiment, the temperature of the engine 100 can be detected by measuring the water temperature in the engine 100 or the temperature of the piston 4.

(6) Motorcycle

Figure 14:
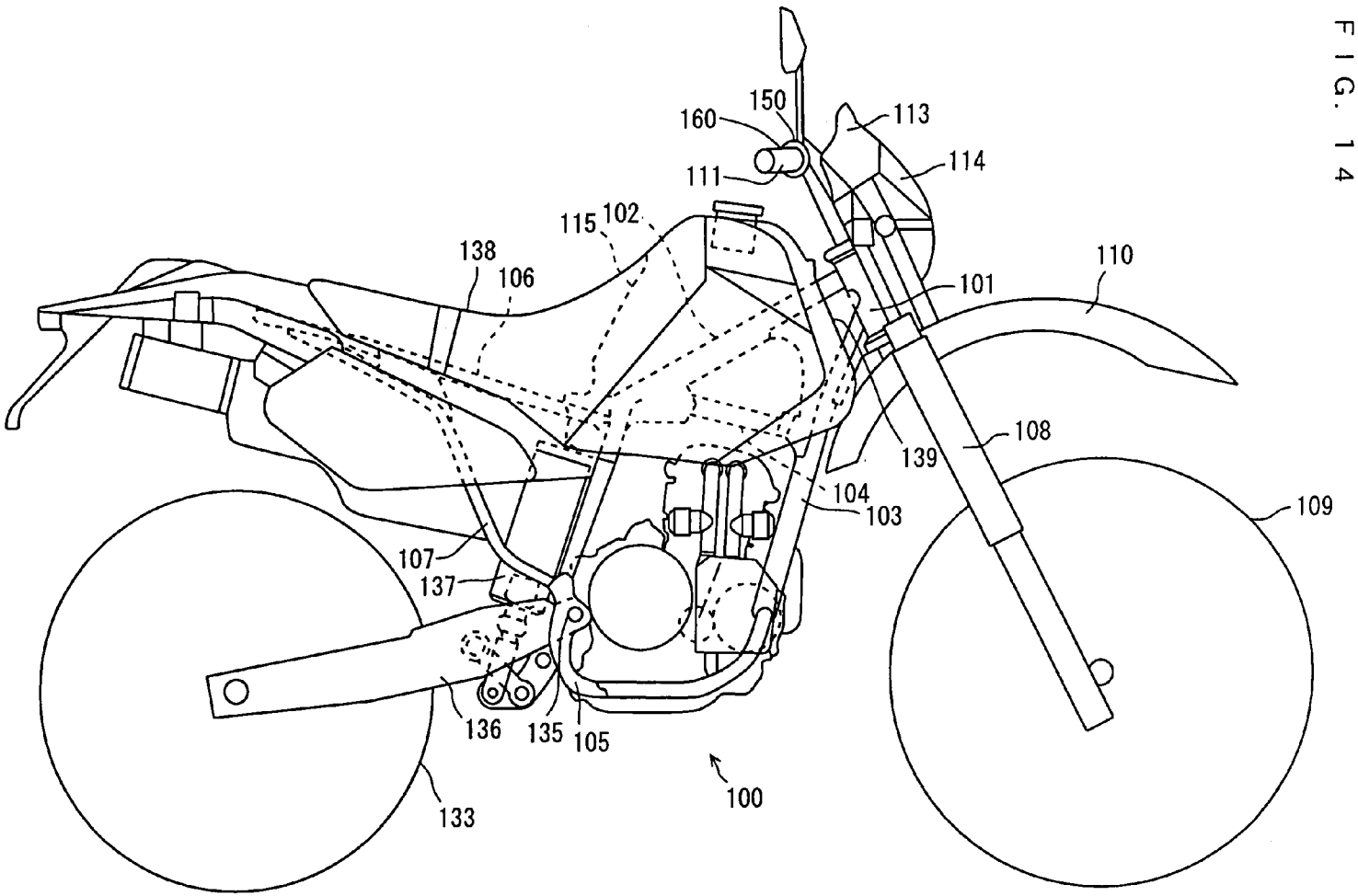
FIG. 14 is a side view of an example of a motorcycle including an engine according to a preferred embodiment.

FIG. 14 is a side view of an example of a motorcycle including the engine 100 according to the preferred embodiment described above.

The motorcycle in FIG. 14, a main frame 102 and the front end of a down tube 103 are connected to a head pipe 101. The main frame 102 is formed to extend obliquely downwardly to the back. The down tube 103 is positioned more to the front and the under side of the main frame 102 to extend downwardly to the back. The main frame 102 and the down tube 103 are connected by a back stay 104 and a pivot shaft supporter 105.

A seat rail 106 is connected at the center of the main frame 102. A back stay 107 is connected between the rear end of the main frame 102 and the rear part of the seat rail 106.

A pair of front forks 108 is provided under the head pipe 101. A front wheel 109 is rotatably attached to the under side of the pair of front forks 108. A front fender 110 is provided to cover the upper part of the front wheel 109.

A handle 111 is pivotably attached to the upper end of the head pipe 101. A main switch 150 is provided at the center of the handle 111, and a starter switch 160 is provided at the grip of the handle 111. A front cowl 113 and a headlight 114 are provided in front of the handle 111.

A fuel tank 115 is attached across the main frame 102. The engine 100 according to the preferred embodiment is provided under the main frame 102.

The pivot shaft supporter 105 connected to the main frame 102 is provided with a pivot shaft 135. The front end of a rear arm 136 is supported by the pivot shaft 135 so that it can swing in the vertical direction. A shock absorber 137 serving to attenuate the impact of the rear arm 136 is provided inside the rear arm 136.

A rear wheel 133 is rotatably attached to the rear end of the rear arm 136. The rotational force of the drive shaft of the engine 100 is transmitted to the rear wheel 133 through a transmission and a chain.

A seat 138 is provided on the seat rail 106. A vehicle body cover 139 is attached to cover the fuel tank 115 and the seat rail 106.

The motorcycle in FIG. 14 includes the engine 100 according to the preferred embodiment described above, and therefore more quick and improved engine starting can be carried out with reduced energy.

(7) Other Preferred Embodiments

According to the third preferred embodiment, after the start of the first engine-starting mode, when the starter switch 160 is not on and the driving duration of the hydraulic pump 1 is equal to or higher than a threshold, the hydraulic pump 1 is stopped. The invention is however not limited to the embodiment. The hydraulic pump 1 may be stopped when for example the starter switch 160 is not on and the oil pressure or cumulative rotation number of the hydraulic pump 1 is equal to or higher than the threshold.

According to the fourth and fifth preferred embodiments described above, the threshold for the driving duration of the hydraulic pump 1 and the threshold for the cumulative rotation number of the hydraulic pump 1 for switching from the first engine-starting mode to the second engine-starting mode are set based on the temperature of the engine 100, but these thresholds may be constant values.

Furthermore, according to the above described embodiments, a motorcycle has been described as an example of a vehicle employing the engine 100 including the hydraulic valve driving device according to the invention, but the invention is not limited to the preferred embodiment and is applicable to any other vehicle having an engine including a hydraulic valve driving device such as an automobile, a tricycle, and an ATV (All Terrain Vehicle; vehicle designed for off-road use). The engine including the valve driving device according to the invention may be applied to a mechanical apparatus such as a generator other than such vehicles.

(8) Correspondences between Elements Recited in Claims and Those in Preferred Embodiments In the following paragraphs, non-limiting examples of correspondences between various elements recited in the claims below and those described above with respect to various preferred embodiments of the present invention are explained.

In the preferred embodiments described above, the hydraulic pump driving motor 2 corresponds to the first motor, the starter motor 20 corresponds to the second motor, the starter motor 30 corresponds to the common motor, and the valve actuator 11 corresponds to the hydraulic valve actuator.

The transmission switching mechanisms 3, 6, 23, and 26 correspond to the transmission mechanism, the one-way clutch 3*c* corresponds to the first one-way clutch, and the one-way clutch 6*b* corresponds to the second one-way clutch.

The path between the starter motor 30 and the hydraulic pump 1 corresponds to the first rotational transmission path, one of the rotational transmission paths correspond to the second rotational transmission path, the other transmission path corresponds to the third transmission path, the one-way clutch 23*b* corresponds to the third one-way clutch, and the one-way clutch 26*d* corresponds to the fourth one-way clutch. The switching clutch 26*a* corresponds to the first switching clutch, and the switching clutch 26*e* corresponds to the second switching clutch. The main switch 150 corresponds to the main switch, the controller 14 corresponds to the controller, and the starter switch 160 corresponds to the instructing device.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A hydraulic valve driving device that drives a valve in an engine having a crank, comprising:

a hydraulic valve actuator operable to drive the valve;

a hydraulic pump that generates hydraulic pressure for the valve actuator;

first and second motors that generate rotational force; and a transmission mechanism that operates in a first engine-starting mode and then in a second engine-starting mode at the time of engine starting, wherein the transmission mechanism transmits rotational force from the first motor to the hydraulic pump while the crank is at rest in the first engine-starting mode, and the transmission mechanism transmits rotational force from the second motor to the crank and the hydraulic pump in the second engine-starting mode; and wherein the transmission mechanism switches from the first engine-starting mode to the second engine-starting mode when the hydraulic pressure of the hydraulic pump reaches at least a prescribed value during operation in the first engine-starting mode.

2. The hydraulic valve driving device according to claim 1, wherein the first and second motors are provided discretely, and the first motor is at rest in the second engine-starting mode.

3. The hydraulic valve driving device according to claim 2, wherein the second motor drives the crank, and the transmission mechanism transmits the rotational force of the crank to the hydraulic pump in the second engine-starting mode.

4. The hydraulic valve driving device according to claim 3, wherein the transmission mechanism comprises a clutch that switches transmission of rotational force from the first motor to the hydraulic pump in the first engine-starting mode to transmission of rotational force from the crank to the hydraulic pump in the second engine-starting mode.

5. The hydraulic valve driving device according to claim 4, wherein the clutch comprises:

a first one-way clutch provided in a rotational transmission path between the first motor and the hydraulic pump to transmit rotational force from the first motor to the hydraulic pump but not from the hydraulic pump to the first motor; and a second one-way clutch provided in a rotational transmission path between the crank and the hydraulic pump to transmit rotational force from the crank to the hydraulic pump but not from the hydraulic pump to the crank.

6. The hydraulic valve driving device according to claim 1, wherein the first and second motors are a common motor.

7. The hydraulic valve driving device according to claim 6, wherein the common motor includes a starter motor that starts the engine, and the transmission mechanism transmits rotational force from the starter motor to the hydraulic pump in the first engine-starting mode, and transmits rotational force from the starter motor to the crank and the hydraulic pump in the second engine-starting mode.

8. The hydraulic valve driving device according to claim 6, wherein the transmission mechanism comprises:

a third one-way clutch provided in a first rotational transmission path between the starter motor and the hydraulic pump to transmit rotational force from the starter motor to the hydraulic pump but not from the hydraulic pump to the starter motor;

a first switching clutch provided in a second rotational transmission path between the hydraulic pump and the crank to switch between connected and disconnected states of the hydraulic pump and the crank;

a fourth one-way clutch provided between the first switching clutch in the second rotational transmission path and the crank to transmit rotational force from the hydraulic pump to the crank but not from the crank to the hydraulic pump; and a second switching clutch provided in a third rotational transmission path between the crank and the hydraulic pump to switch between connected and disconnected states of the crank and the hydraulic pump.

9. The hydraulic valve driving device according to claim 1, further comprising:

a main switch that controls supply of electric power to the engine; and a controller that sets the transmission mechanism to the first staring mode when the main switch is turned on.

10. The hydraulic valve driving device according to claim 9, further comprising an instructing device that instructs driving of the crank, wherein the controller stops operation of the hydraulic pump after the start of the first engine-starting mode in response to turning on of the main switch, at least one of when the hydraulic pressure of the hydraulic pump reaches at least a prescribed value and when the cumulative rotation pumper of the hydraulic pump reaches at least a prescribed rotation number, provided that there is no instruction from the instructing device to drive the crank.

11. The hydraulic valve driving device according to claim 9, further comprising an instructing device that instructs driving of the crank, wherein the controller switches the mode of the transmission mechanism from the first engine-starting mode to the second engine-starting mode after the start of the first engine-starting mode, at least one of when the hydraulic pressure of the hydraulic pump is less than a prescribed value, when the driving duration of the hydraulic pump is less than a prescribed period, and when the cumulative rotation number of the hydraulic pump is less than a prescribed rotation number, provided that there is an instruction from the instructing device to drive the crank.

12. The hydraulic valve driving device according to claim 11, wherein the valve includes a plurality of valves, and in the second engine-starting mode the second motor drives the crank to carry out cranking while the engine is yet to be started, and a valve actuator opens at least one of the plurality of valves during the cranking.

13. The hydraulic valve driving device according to claim 12, wherein the valve actuator opens at least one of the plurality of valves with such a lift amount that the valve does not collide against a piston in the engine during cranking in the second engine-starting mode.

14. The hydraulic valve driving device according to claim 13, wherein after at least one of the plurality of valves is opened and before the cranking ends, the valve actuator keeps the lift amount of the opened valve at a constant level.

15. The hydraulic valve driving device according to claim 12, wherein the controller starts the engine when the rotational speed of the engine reaches at least a prescribed speed in the second engine-starting mode and has the crank driven by the engine.

16. A hydraulic valve driving device that drives a valve in an engine having a crank, comprising:

a hydraulic valve actuator operable to drive the valve;

a hydraulic pump that generates hydraulic pressure for the valve actuator;

first and second motors that generate rotational force; and a transmission mechanism that operates in a first engine-starting mode and then in a second engine-starting mode at the time of engine starting, wherein the transmission mechanism transmits rotational force from the first motor to the hydraulic pump while the crank is at rest in the first engine-starting mode, and the transmission mechanism transmits rotational force from the second motor to the crank and the hydraulic pump in the second engine-starting mode;

wherein the transmission mechanism switches from the first engine-starting mode to the second engine-starting mode when the operation duration of the hydraulic pump reaches at least a prescribed period during operation in the first engine-starting mode; and wherein the prescribed period is set based on the temperature of the engine.

17. The hydraulic valve driving device according to claim 16, wherein the transmission mechanism switches from the first engine-starting mode to the second engine-starting mode when the pumplative rotation pumper of the hydraulic pump reaches at least a prescribed rotation number during operation in the first engine-starting mode.

18. The hydraulic valve driving device according to claim 17, wherein the prescribed rotation pumper is set based on the temperature of the engine.

19. An engine, comprising:

a cylinder having a valve;

a piston stored in the cylinder and capable of reciprocating therein;

a crank that transforms the reciprocating motion of the piston into rotational motion; and a hydraulic valve driving device that drives the valve, the hydraulic valve driving device comprising:

a hydraulic valve actuator operable to drive the valve;

a hydraulic pump that generates hydraulic pressure for the valve actuator;

first and second motors that generate rotational force; and a transmission mechanism that operates in a first engine-starting mode and then in a second engine-starting mode at the time of engine starting, wherein the transmission mechanism transmits rotational force from the first motor to the hydraulic pump while the crank is at rest in the first engine-starting mode, and the transmission mechanism transmits rotational force from the second motor to the crank and the hydraulic pump in the second engine-starting mode; and wherein the transmission mechanism switches from the first engine-starting mode to the second engine-starting mode when the hydraulic pressure of the hydraulic pump reaches at least a prescribed value during operation in the first engine-starting mode.

20. A vehicle, comprising:

an engine that generates power; and a driving wheel driven by the power generated by the engine, the engine comprising:

a cylinder having a valve;

a piston stored in the cylinder and capable of reciprocating therein;

a crank that transforms the reciprocating motion of the piston into rotational motion; and a hydraulic valve driving device that drives the valve, the hydraulic valve driving device comprising:

a hydraulic valve actuator operable to drive the valve;

a hydraulic pump that generates hydraulic pressure for the valve actuator;

first and second motors that generate rotational force; and a transmission mechanism that operates in a first engine-starting mode and then in a second engine-starting mode at the time of engine starting, wherein the transmission mechanism transmits rotational force from the first motor to the hydraulic pump while the crank is at rest in the first engine-starting mode, and the transmission mechanism transmits rotational force from the second motor to the crank and the hydraulic pump in the second engine-starting mode; and wherein the transmission mechanism switches from the first engine-starting mode to the second engine-starting mode when the hydraulic pressure of the hydraulic pump reaches at least a prescribed value during operation in the first engine-starting mode.

* * * * *